US010076181B2

(12) United States Patent
Hess et al.

(10) Patent No.: US 10,076,181 B2
(45) Date of Patent: Sep. 18, 2018

(54) TOOTHBRUSH HAVING A BRISTLE AREA DESIGN

(71) Applicant: TRISA HOLDING AG, Triengen (CH)

(72) Inventors: Walter Hess, Obernau (CH); Oskar Trevisan, Reussbuhl (CH)

(73) Assignee: TRISA HOLDING AG, Triengen (CH)

( * ) Notice: Subject to any disclaimer, the term of this patent is extended or adjusted under 35 U.S.C. 154(b) by 423 days.

(21) Appl. No.: 14/715,034

(22) Filed: May 18, 2015

(65) Prior Publication Data

US 2015/0313351 A1 Nov. 5, 2015

Related U.S. Application Data

(62) Division of application No. 13/816,843, filed as application No. PCT/EP2011/003858 on Aug. 1, 2011, now Pat. No. 9,066,579.

(30) Foreign Application Priority Data

Aug. 18, 2010 (EP) ..... 10008600

(51) Int. Cl.
*A46B 9/04* (2006.01)
*A46B 3/06* (2006.01)
(Continued)

(52) U.S. Cl.
CPC ..... *A46B 9/04* (2013.01); *A46B 3/06* (2013.01); *A46B 9/025* (2013.01); *A46B 9/026* (2013.01);
(Continued)

(58) Field of Classification Search
CPC .... A46B 3/04; A46B 3/06; A46B 3/22; A46B 7/00; A46B 9/04; A46B 9/025; A46B 9/026; A46B 9/028; Y10S 15/05
(Continued)

(56) References Cited

U.S. PATENT DOCUMENTS 2,488,873 A 11/1949 Charles
3,229,318 A * 1/1966 Clemens ..... A46B 9/04 15/167.1
(Continued)

FOREIGN PATENT DOCUMENTS

AU 2003252861 A1 4/2005
DE 1273482 * 7/1968
(Continued)

OTHER PUBLICATIONS

International Search Report issued in International Patent Application No. PCT/EP2011/003858 dated Dec. 1, 2011.
(Continued)

*Primary Examiner* — Mark Spisich
(74) *Attorney, Agent, or Firm* — Oliff PLC

(57) ABSTRACT

The present invention concerns a process for producing toothbrushes covered with bristles in an anchor-free manner, in which a tuft of bristles with cylindrical bristles and/or pointed bristles is introduced into a receiving recess of a mold of a bristle-providing machine and, by means of a profiled pin guided in the receiving recess, force is applied to the end facing the pin of the bristles of the tuft of bristles for the alignment thereof, so that the bristles of the tuft of bristles are aligned by means of an end face of the profiled pin and, as a result, form the topography that complements the topography of the end face of the profiled pin, wherein the profiled pin has on the end face that acts on the bristles a discontinuous surface, which forms multiple levels. This achieves a bristle area configuration that has multiple areas of use. A correspondingly produced toothbrush is also described.

14 Claims, 15 Drawing Sheets

(51) Int. Cl.
*A46B 9/02* (2006.01)
*A46D 3/04* (2006.01)

(52) U.S. Cl.
CPC ..... *A46B 9/028* (2013.01); *A46D 3/04* (2013.01); *Y10S 15/05* (2013.01)

(58) Field of Classification Search
USPC ..... 15/167.1, 171, 191.1, 192, 193, DIG. 5
See application file for complete search history.

(56) References Cited

U.S. PATENT DOCUMENTS

| | | | | |
|---|---|---|---|---|
| 5,454,626 | A | 10/1995 | Schiffer et al. | |
| 5,799,353 | A * | 9/1998 | Oishi | A46B 9/045 15/167.1 |
| 5,926,897 | A | 7/1999 | Volpenhein | |
| D425,306 | S | 5/2000 | Beals et al. | |
| 6,290,302 | B1 | 9/2001 | Boucherie | |
| 6,290,303 | B1 | 9/2001 | Boucherie | |
| 6,523,907 | B1 | 2/2003 | Buckner et al. | |
| 9,655,435 | B2 * | 5/2017 | Kraemer | A46B 9/04 |
| 2002/0162183 | A1 * | 11/2002 | Cho | A46B 9/06 15/167.1 |
| 2003/0132661 | A1 | 7/2003 | Sato et al. | |
| 2004/0117934 | A1 * | 6/2004 | Pfenniger | A46B 3/06 15/167.1 |
| 2009/0013489 | A1 * | 1/2009 | Binet | A46B 9/028 15/167.1 |
| 2010/0223745 | A1 * | 9/2010 | Kraemer | A46B 9/02 15/167.1 |

FOREIGN PATENT DOCUMENTS

| | | | | |
|---|---|---|---|---|
| DE | 4330171 | A1 | | 3/1995 |
| DE | 19542393 | A1 | | 5/1997 |
| DE | 19832436 | A1 | | 1/2000 |
| EP | 716821 | | * | 6/1996 |
| EP | 972464 | A1 | | 1/2000 |
| EP | 0972465 | A1 | | 1/2000 |
| EP | 1425989 | A1 | | 6/2004 |
| EP | 1449458 | A1 | | 8/2004 |
| EP | 1894489 | A2 | | 3/2008 |
| JP | 8-21947 | | * | 8/1996 |
| JP | 2000-118 | | * | 1/2000 |
| JP | 2001-218623 | | * | 8/2001 |
| JP | 2002-136341 | | * | 5/2002 |
| JP | 2002-345554 | | * | 12/2002 |
| JP | 2008-194497 | | * | 8/2008 |
| WO | 2004/037038 | | * | 5/2004 |
| WO | 2009000903 | A1 | | 12/2008 |

OTHER PUBLICATIONS

International Preliminary Report on Patentability issued in International Patent Application No. PCT/EP2011/003858 dated Feb. 19, 2013.

* cited by examiner

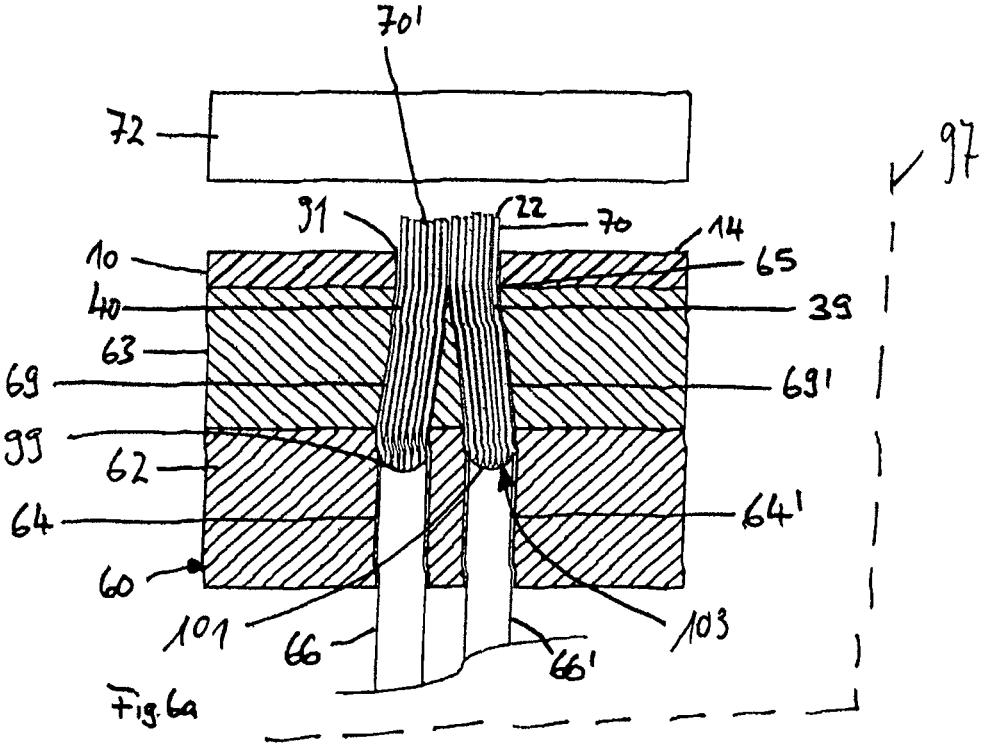
Fig. 6a
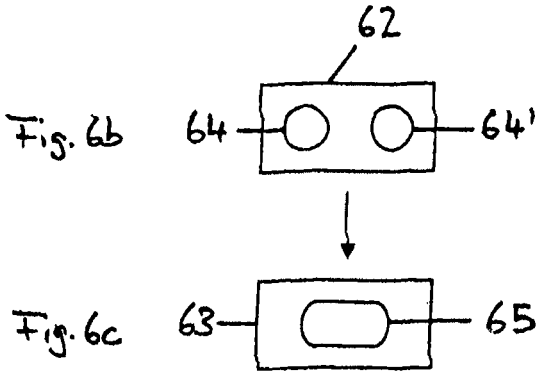
Fig. 6b
Fig. 6c 64
62

22
71
39,40
67

67
75
71
39,40
22

64
62

77
22
71
39,40
67

75
67
71
73
22
39,40

64
62

73'
71
22
39,40
67
73"

75
73'
67
73"
71
39,40
22

64

22
77
77'

68
66

39,40
22
101
111,112
68
105
66
109

64

22
77

39,40
68
66

77
39,40
22
111,112
68
66
109

77,77'
68
66
68

111,112
68
68
107,109
105
22
66
68
66

68
66

66

68

64

68
66

66
68
22

75/79
73
75
39,40
22

64

68
66
66

68
22

73
39,40
75
22

64

68
68
66

66
68
68
73
22

73
75
22

64

68
66

75
22

B
77
75
22
22

B

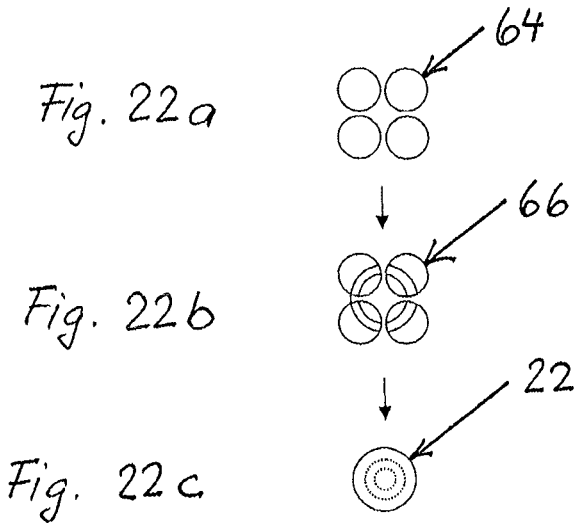
Fig. 22a
Fig. 22b
Fig. 22c
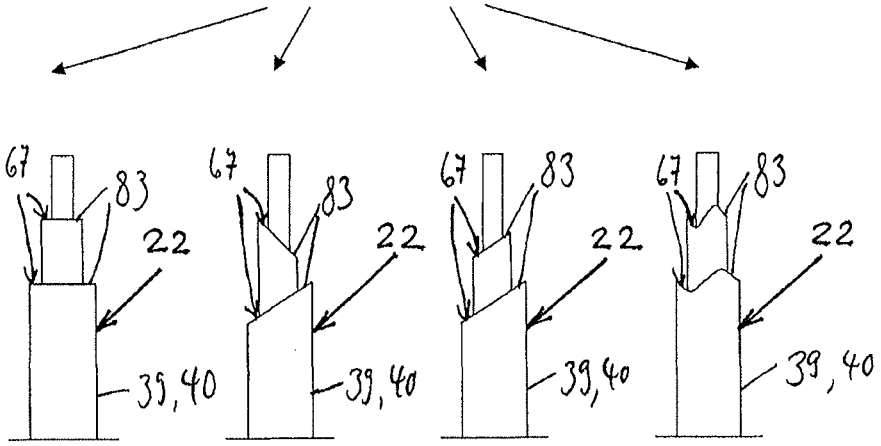
Fig. 22d Fig. 22e Fig. 22f Fig. 22g

64

66

68, 87
22

C
73
73'
22
22
85
C

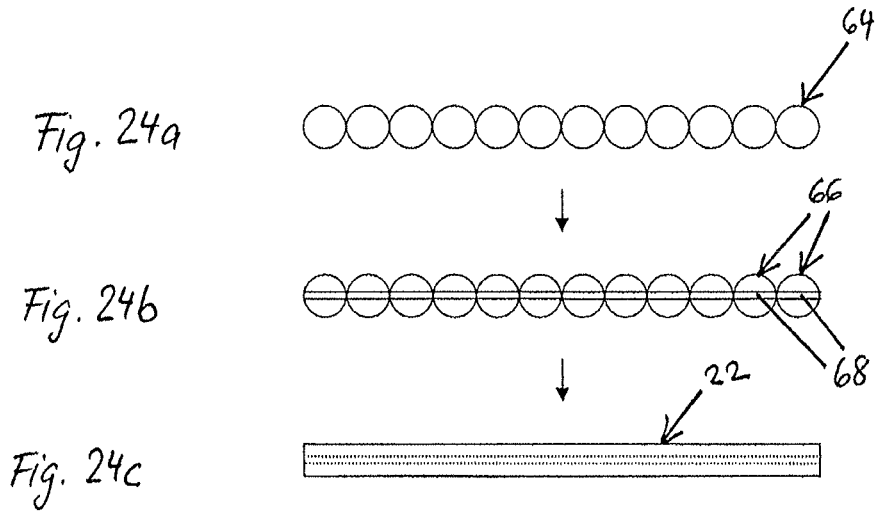
Fig. 24a
Fig. 24b
Fig. 24c
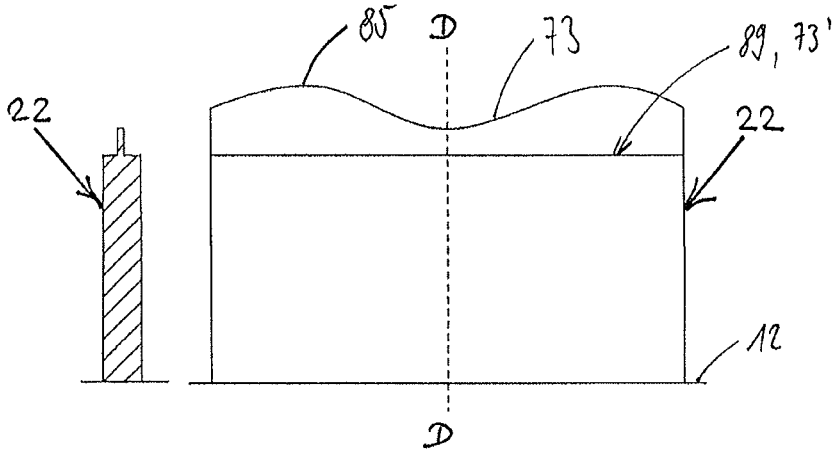
Fig. 24e
Fig. 24d

Fig. 25a
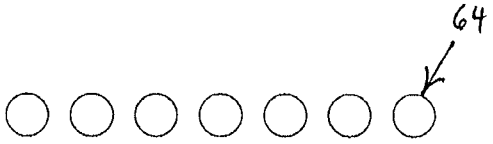
Fig. 25b
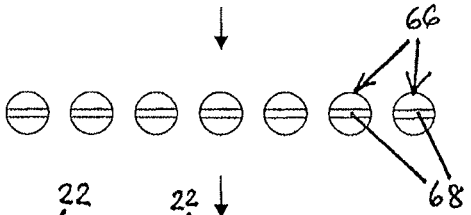
Fig. 25c
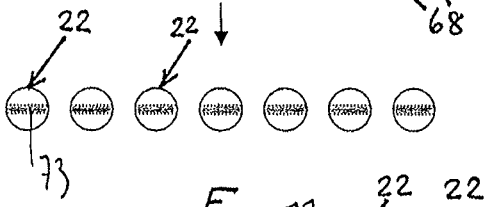
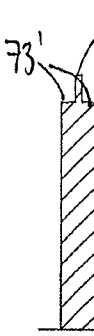
Fig. 25e
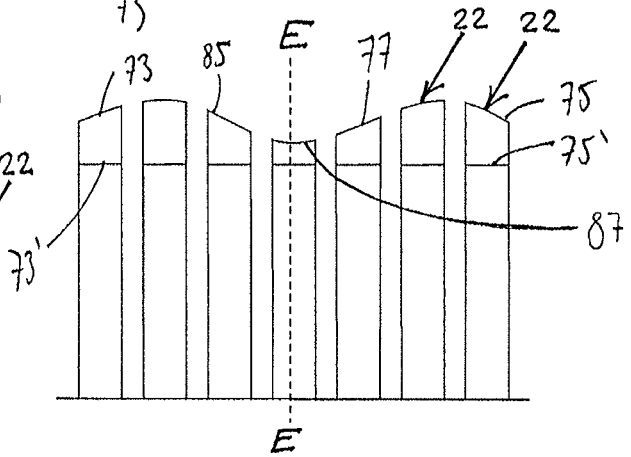
Fig. 25d

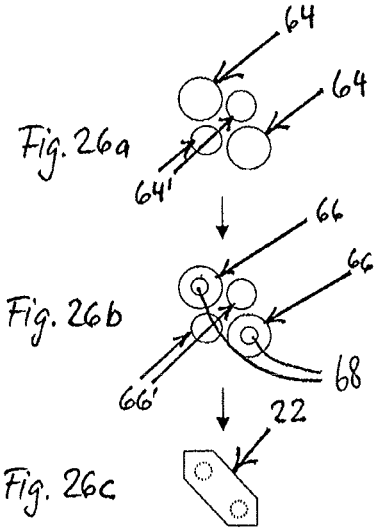
Fig. 26a
Fig. 26b
Fig. 26c
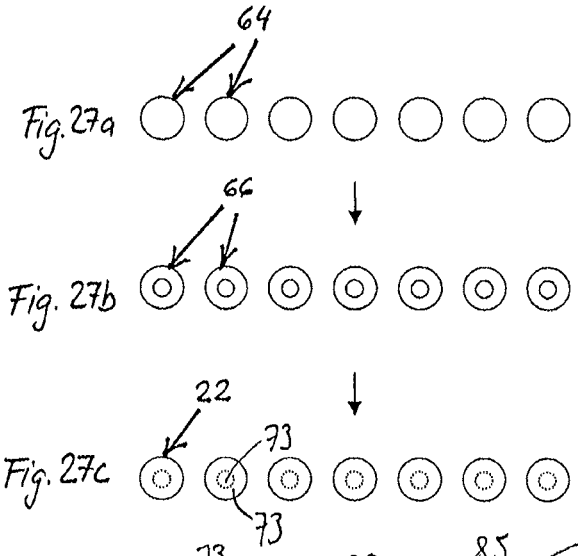
Fig. 27a
Fig. 27b
Fig. 27c
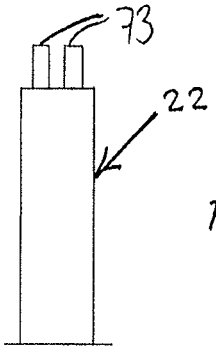
Fig. 26d
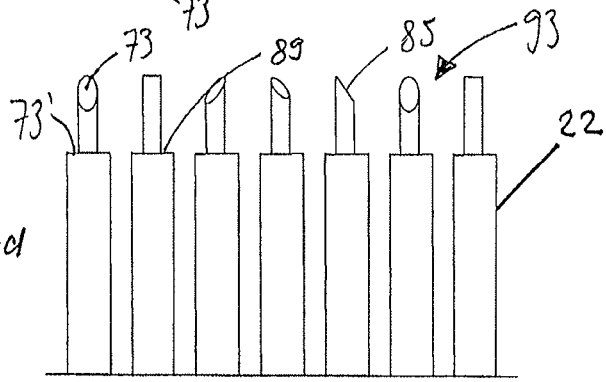
Fig. 27d
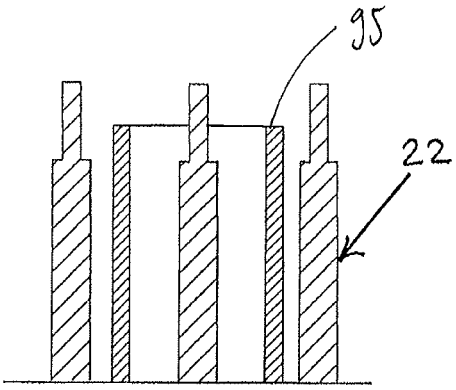
Fig. 28a
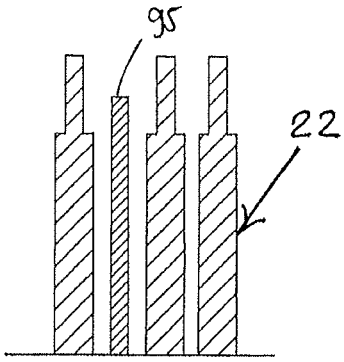
Fig. 28b

TOOTHBRUSH HAVING A BRISTLE AREA DESIGN

This is a Division of application Ser. No. 13/816,843 filed Feb. 13, 2013, now U.S. Pat. No. 9,066,579, which in turn is a National Phase of International Patent Application PCT/EP2011/003858 filed Aug. 1, 2011, which claims priority to European Patent Application No. 10008600.8 filed Aug. 18, 2010. The disclosures of the prior applications are hereby incorporated by reference herein in their entireties.

The present invention concerns a toothbrush with a bristle area configuration and a process and a device for producing the same.

Toothbrushes usually have a brush head with a bristle area formed by tufts of bristles. Such toothbrushes are known from the prior art. Over the course of time, the bristle areas of the toothbrushes have undergone varied designs to improve their use, that is to say on the one hand the cleaning effect and on the other hand the handling for the user. One of these developments concerns the use of profiled bristle areas and tufts of bristles with bristles standing up to different heights.

U.S. Pat. No. 5,926,897 discloses a toothbrush with a bristle area consisting of tufts of bristles. This bristle area is of a profiled configuration and the individual tufts of bristles have a number of bristles standing up higher, which form a higher end area.

DE 198 32 436 describes a process for producing brushes, in particular toothbrushes. The process shows the working of tufts of bristles with bristles of different lengths, the working of the bristles being carried out in various steps by means of lateral deflection.

US Design 425,306 shows an ornamental bristle area with substantially triangular tufts of bristles, at the corners of which higher bristles are arranged.

EP 1 425 989 discloses toothbrushes with pointed bristles and a process for producing the same. The bristles may in this case have two identical pointed ends or different ends, that is to say a non-pointed end and a pointed end.

WO 2009/000903 describes a toothbrush with tufts of bristles, these tufts of bristles having on the one hand shorter, non-pointed bristles and on the other hand longer, pointed bristles. The longer bristles may be randomly distributed in the tuft of bristles or arranged centrally in an inner region of the tuft of bristles.

The object on which the present invention is based is that of providing a toothbrush which can be simply produced, has a very good cleaning effect and is easy to handle.

The object is achieved by the toothbrushes of the disclosed embodiments.

In the case of the process according to the invention for producing toothbrushes covered with bristles in an anchor-free manner, a tuft of bristles with cylindrical bristles and/or pointed bristles is introduced into a receiving recess of a mold of a bristle-providing machine. By means of a profiled pin guided in the receiving recess, force is applied to the end facing the pin of the bristles of the tuft of bristles for the alignment thereof, so that the bristles of the tuft of bristles are aligned by means of an end face of the profiled pin and, as a result, form the topography that complements the topography of the end face of the profiled pin, the profiled pin having on the end face that acts on the bristles a discontinuous surface, which forms multiple levels. Discontinuous means that the surface has an edge-like transition, i.e. an edge.

A device for carrying out the process according to the invention for producing a toothbrush comprises a die with profiled pins guided therein, the profiled pins having a highly polished or lapped surface.

The toothbrush according to the invention is produced from plastic and comprises at least one hard component and/or one or more soft components. Furthermore, the basic body of the toothbrush, consisting of a head part, a handle part and a neck part connecting the head part and the handle part, comprises a carrier element. With preference, the carrier element is a bristle-carrying plate. The bristle area, formed by tufts of bristles, is arranged on the carrier element.

Not only the head part, neck part and handle part but also the carrier element comprise at least one hard component and/or at least one soft component. It goes without saying that simpler configurations, in which the head part, neck part and handle part and/or the carrier element is produced exclusively from one or more hard components, may also be chosen.

With the soft component, generally soft elastic cleaning and massaging elements are molded onto the carrier element before the carrier element is provided with cylindrical, extruded bristles. Thanks to injection molding technology, these cleaning and massaging elements can take a wide variety of forms.

One particular form of the cleaning and massaging elements is that of very fine pointed bristles that are based on the cylindrical, extruded bristles. Like the cleaning and massaging elements, the molded bristles are generally molded onto the carrier element from a hard component, and, like the cylindrical extruded bristles, are arranged in the tufts of bristles in various forms or basic shapes (circular, elliptical, crescent-shaped, rectangular, etc.).

Tufts with molded bristles have over 1 to 20 individually molded bristles, preferably 3 to 15 molded bristles and with particular preference over 5 to 10 molded bristles.

As a difference from the conventional, extruded and cylindrical bristles, the molded bristles have, as a result of being able to be demolded in the injection mold, a configuration that substantially tapers toward the used end (substantially stepped, conical or frustoconical).

Like the conventional, extruded and cylindrical bristles, the molded bristles have fine end regions with a diameter of about 0.15 mm to 0.25 mm. Molded bristles are described in detail in the patent application with the application number EP 11 000 032.0. The disclosure of EP 11 000 032.0 is consequently incorporated in full into this document.

The head part and the interface with respect to the carrier element and the carrier element itself are preferably produced from the same hard component. The following thermoplastics are used with preference as hard components: styrene polymers, for example styrene acrylonitrile (SAN), polystyrene (PS), acrylonitrile butadiene styrene (ABS), styrene methyl methacrylates (SMMA) and styrene butadiene; polyolefins such as polypropylene (PP) or polyethylene (PE), both in the form of high-density polyethylene (HDPE) and in the form of low-density polyethylene (LDPE); polyesters, for example polyethylene terephthalate (PET) in the form of acid-modified polyethylene terephthalate (PETA) or in the form of glycol-modified polyethylene terephthalate (PETG), polybutylene terephthalate (PBT), acid-modified poly(cyclohexylenedimethylene terephthalate) (PCT-A) and glycol-modified poly(cyclohexylenedimethylene terephthalate) (PCT-G); cellulose derivatives, for example cellulose acetate (CA), cellulose acetobutyrate (CAB), cellulose propionate (CP), cellulose acetate phthalate (CAP) and cellulose butyrate (CB); polyamides (PA), for example PA 6.6, PA 6.10, PA 6.12; polymethylmethacrylate (PMMA); polycarbonate (PC); polyoxyethylene (POM); polyvinyl chloride (PVC) and polyurethane (PUR). Particularly preferred is polypropylene with a modulus of elasticity in the range from 1000 N/mm$^2$ to 2400 N/mm$^2$, most particularly preferred in the range from 1300 N/mm$^2$ to 1800 N/mm$^2$.

Used with preference as soft components are thermoplastic elastomers (TPE): thermoplastic polyurethanes (TPE-U); thermoplastic styrene elastomers (TPE-S), for example a styrene-ethylene-butylene-styrene copolymer (SEBS) or styrene-butadiene-styrene copolymer (SBS); thermoplastic polyamide elastomers (TPE-A); thermoplastic polyolefin elastomers (TPE-O); or thermoplastic polyester elastomers (TPE-E). In addition, the thermoplastic polyurethanes (PUR) and polyethylenes (PE) may also be used as the soft component. A TPE-S is used with preference. With preference, the Shore A hardness of the soft components used is less than 90 Shore A.

Although, with preference, the molded bristles are likewise produced from a soft component, they form an exception with respect to the Shore hardness. On account of the improved resilience, soft materials with a Shore hardness D of 20 to 80, preferably 40 to 70, are preferably used.

With preference, the hard and soft components that are used are processed by the two- or multi-component injection-molding process. A material bond and/or positive connection thereby generally forms between the components.

The expression bristles refers to the individual filaments from which tufts of bristles are made. The expressions bristle, bristle filament or filament are used synonymously and all refer to the aforementioned individual filaments of a tuft of bristles.

Conventional, extruded, cylindrical bristles may consist of various materials. Polyamides (PA) or polyesters (PBT) are used for example. An example of a polyamide that is used is PA6.12.

In this respect, polyamides are used with preference for cylindrical bristles, while polyesters are preferably used for bristles that are pointed at one or both ends. In this case, the conventional, extruded, cylindrical bristles of polyester are brought into a pointed form by means of a chemical process. The pointed bristles generally have a cylindrical part with a substantially constant diameter and a conical pointed part. The tip of the cone is aligned toward the used end.

The conventional, extruded bristles may have different diameters. These bristles generally have a cylindrical form over part of the length. With preference, the cross section is at least approximately in the form of a circular cylinder and constant over a substantial portion of the length of the bristle; in this way, a circular cylinder is formed. Other cross-sectional forms are possible, for example square, rectangular or rhomboidal.

Pointed bristles have on the one hand a cylindrical part, in which they have a cross section that remains constant, on the other hand these bristles taper over a certain region toward at least one used end. In the case of bristles that are pointed at one end, as may be used in the present case in toothbrushes according to the invention, the region of the pointed bristles that adjoins the pointed region, and so is opposite from the free end, has a cylindrical cross section.

Furthermore, conventional bristles may have various types of ends. The bristle end of cylindrical bristles is generally on the one hand rounded-off, at least approximately, in a hemispherical or frustoconical form, while on the other hand the bristle end of pointed bristles runs out to a point. The bristle ends of cylindrical bristles are generally worked, in order to avoid any sharp edges at the bristle end that could result, for example, from cutting. Working means that, for example after they have been cut to a length for further processing, the ends of the cylindrical bristles are rounded. Mechanical and/or thermal processes are thereby used. As a result, sharp edges of the bristle ends of the cylindrical bristles are broken and an at least approximately hemispherical bristle end is achieved. The bristles are generally cut and worked before insertion into the carrier element.

The bristles may be at least partially colored. Bristles consisting of polyester (PBT) are colored by chemical means. If the bristles consist of polyamide (PA), food dyes may also be used for the coloring. For example, Aluminum Lake of 3,3'-dioxo-2,2'-diindolinyidene-5,5'-disulfonic acid is used for a blue coloration, Aluminum Lake of 5-hydroxy-1-(4-sulfophenyl)-4-(4-sulfophenylazo)-3-pyrazolecarboxylic acid is used for a yellow coloration or Aluminum Lake of 6-hydroxy-5-(4-sulfophenylazo)-2-naphthalene sulfonic acid is likewise used for a yellow coloration.

Fully or partially colored bristles must be coated in order to ensure that they can undergo further machine processing. For example, in order to reduce the friction between the bristles and the machine parts. The bristles are generally colored before insertion into the carrier element.

As a difference from the molded bristles, which are molded onto the carrier element, conventional, extruded bristles are only anchored on the carrier element once the latter has been produced.

Tufts of bristles according to the invention comprise conventional bristles with at least two different lengths. That is to say that the free ends of the bristles stand up to different heights from the bristle-carrying upper side of the head part or carrier element and, in the case of tufts of bristles with bristles of two different lengths, form two different areas of use. The portion of the tuft of bristles which, in cross section, contains all the bristles is referred to as the bristle tuft stock. The portion of the tuft of bristles which, in cross section, comprises only the bristles with higher bristle ends is referred to as the reduced part of the tuft of bristles. The aforementioned two areas of use are formed on the one hand by the bristle ends of the bristles of shorter length and on the other hand by the bristle ends of the bristles of greater length, that is to say with the higher bristle ends.

Extensive studies have shown that the exposure of the higher bristle ends in the reduced part of the tuft of bristles, the number of higher bristles, the differences in length in relation to the other bristles and the arrangement thereof within the tuft of bristles and with respect to further cleaning elements, such as molded bristles or soft-elastic cleaning and massaging elements, have a major influence on the cleaning effect of the brush head.

The bristle tuft stock has, with preference, a height of from 6 mm to 11 mm, with particular preference from 8 mm to 10 mm. The height of the reduced part of the tuft of bristles is, with preference, 9 mm to 15 mm, with particular preference 10 mm to 12 mm. The height is in this case respectively measured from the upper side of the head part or the carrier element, actually from the point where the bristle emerges from the surface.

The distance of the end face of the bristle tuft stock from the end face of the reduced part is 0.5 mm to 5 mm, preferably 2 mm to 3 mm. As will be described in more detail later, multiple steps with end faces may be formed within a tuft of bristles. The distances between the steps, or end faces, preferably have the dimensions described above. The end faces within a tuft of bristles generally do not form a continuous profile and are significantly offset from one another.

As described above, tufts of bristles comprise conventional, extruded bristles with bristle ends standing up to different heights. The bristles may, moreover, have different bristle ends. On the one hand, the bristle ends may be rounded off, as described for cylindrical bristles; on the other hand, bristles may have a region which tapers toward their free end and has a pointed bristle end.

In one embodiment, all the bristles have pointed bristle ends. In a preferred variant, only bristles with a higher bristle end have a pointed bristle end. This means that only the reduced part of a tuft of bristles has bristles with pointed bristle ends. The other bristles of this tuft of bristles with a lower bristle end are cylindrical bristles with a rounded-off bristle end. Consequently, the higher area of use is formed by bristles with pointed bristle ends, whereas the lower area of use is formed by bristles with a rounded-off bristle end.

In a further embodiment, the situation is precisely the opposite. The bristles with a higher bristle end have rounded-off bristle ends. On the other hand, in this embodiment the other bristles, with a lower bristle end, have pointed bristle ends. Consequently, in this embodiment the higher area of use is formed by free, rounded-off bristle ends and the lower area of use is formed by free, pointed bristle ends. These embodiments may also only relate to a substantial proportion of the bristles of the areas of use.

Both conventional, cylindrical bristles with a rounded-off bristle end and conventional bristles with a pointed bristle end may be fully colored, or with preference also only partially colored. The colored region of a bristle extends over a length of from 2 mm to 10 mm, preferably from 3 mm to 8 mm. Likewise with preference, only bristles with a higher bristle end are colored. Moreover, in the case of merely partially colored bristles, the colored part of the bristles extends with preference toward the free bristle ends thereof. As an alternative embodiment, only bristles with a lower bristle end have a colored region, this region preferably extending toward the free bristle ends.

Apart from design and esthetic aspects, the at least partial coloration of the bristles may also be accompanied by other advantages. Configuration of the coloration or the color itself has the effect that the fading of the colored region of a bristle or the washing out of the color as the time in which the brush is used passes by are used by the user as an efficient indicator that the useful lifetime of a toothbrush according to the invention is coming to an end. This gives the user an advantageous indication of use.

The bristle area is formed by the tufts of bristles arranged on the carrier element. The tufts of bristles may in this case be arranged in a grid on the carrier element. The bristle area may be formed by one or preferably two or more different types of tufts of bristles. Apart from tufts of bristles with bristles which have at least two bristle ends standing up to different heights, there may also be tufts of bristles with cylindrical bristles or tufts of bristles with bristles which have a pointed free end or else tufts of bristles which consist of a combination of cylindrical and pointed bristles.

In the bristle area, the tufts of bristles with bristle ends standing up to different heights may be arranged exclusively in the outermost regions or peripheral regions, while in the interior of the bristle area there are tufts of bristles which are formed according to the known prior art. For example, cylindrical bristles with a height of bristle ends which may also be made shorter in their bristle length than the tufts of bristles with bristles which have at least two bristle ends standing up to different heights may be provided in the interior of the bristle area. Likewise possible are alternating longitudinal or transverse regions comprising the aforementioned different types of tufts of bristles. The tufts of bristles generally, that is to say including the tufts of bristles with bristles which have at least two bristle ends standing up to different heights, may be configured in a wide variety of cross sections. Examples of this are circular, approximately circular, arcuate, angular, rectangular, elliptical, trapezoidal, crescent-shaped or free-form structures or basic structures.

The tufts of bristles and also the higher bristle ends in the tuft of bristles are preferably arranged substantially perpendicular to the upper side of the head part or of the carrier element. However, an oblique position with respect to the carrier element may also be realized. In this case, the higher ends project from the tuft of bristles at an angle with respect to the carrier element. The orientation of the oblique position is not in this case restricted; the bristles that are affected by the oblique position may assume any desired angle with respect to the longitudinal axis of the toothbrush in the projection perpendicularly on the carrier element. Tufts of bristles with obliquely positioned bristles may be combined in the same bristle area with perpendicular tufts of bristles. In this respect, tests have shown that angles of between 3° and 15°, preferably 5° and 10°, produce the most effective cleaning effect.

Furthermore, in a bristle area, the lengths of the lower bristle ends and also the lengths of the higher bristle ends may be varied. In a bristle area, it is accordingly possible to vary one length or the other length or both lengths and to form a profiled area or an inclined level.

In a further embodiment, the ends of the conventional bristles of different lengths within a tuft of bristles form substantially 2 or more planar regions. In this respect, 2 to 5, preferably 2 or 3, substantially parallel, planar regions or steps may be formed.

The bristle area preferably has different types of such tufts, that is to say, for example, bristle areas with tufts having 2, 3, 4 or 5 levels or steps.

Instead of the planar, parallel regions, regions that are planar and inclined in relation to one another may also be formed. Furthermore, the ends may also form individual regions with a profile; these profiles within the tuft may once again be parallel or inclined in relation to one another. However, the different end regions (levels or profiles) of the individual bristle lengths within a tuft of bristles are preferably greatly offset. The different end regions or steps of a tuft of bristles generally do not form a contiguous profile and are significantly offset in relation to one another in the longitudinal direction of the bristles.

As already described, different tufts of bristles are used with preference within the bristle area. The stepped tufts of bristles may be combined with conventional tufts of bristles. The conventional tufts of bristles do not have multiple steps; the bristle ends do not form end regions that are significantly offset from one another but a substantially contiguous, continuous profile within the tuft. This profile may have a form that is flat and parallel in relation to the carrier elements or oblique in relation to the carrier element. Alternatively, the bristles within an individual tuft of bristles may also form a conical, frustoconical or spherical end region. It goes without saying that the bristles may also form a three-dimensional free-form area as an end region. Conventional tufts of bristles are preferably used in the rear and front regions of the bristle area (seen in the longitudinal direction). Preferably, the so-called power tip is thereby formed. Stepped tufts of bristles tend not be used in these regions.

Tufts of bristles according to the invention are preferably also combined in groups of multiple such tufts of bristles.

These groups consist of at least 2 tufts of bristles. In a further embodiment, 2 to 5 adjacent tufts of bristles, preferably 2 to 3 tufts of bristles, form a smaller group of these tufts of bristles. Alternatively, a greater number of these tufts of bristles form groups which cover a substantial proportion of the tuft of bristles; possibly even the entire tuft of bristles is covered with such tufts. In this configurational variant, over 30%, preferably over 50%, of the tufts form a group.

Combined in groups, the different end regions (levels or profiles) or steps of the tufts of bristles may together form a substantially contiguous profile. This profile may form a level that is parallel, inclined or wavy in relation to the carrier plate. Alternatively, this profile may also form a three-dimensional free-form area. As in the case of the individual tufts of bristles themselves, 2-5, preferably 2 or 3, profiles lying one on top of the other are preferably formed.

One of these profiles is preferably designed to be planar and parallel in relation to the carrier element. The lowermost and/or uppermost profile is/are preferably designed to be planar and parallel in relation to the carrier element.

It goes without saying that it is also conceivable that different end regions (levels or profiles) or steps of groups of the tufts of bristles according to the invention do not together form a contiguous, continuous profile. A combination of tufts of bristles with end regions with a continuous profile and end regions without a contiguous, continuous profile is also conceivable.

Furthermore, the tufts of bristles according to the invention may be combined with additional soft-elastic structures arranged on the carrier element or directly on the head part, the soft-elastic structures consisting of at least one of the soft components described above. Such soft-elastic structures are preferably configured as soft-elastic cleaning or massaging elements. On account of the great freedom of design, the soft-elastic cleaning or massaging elements may take a wide variety of forms. There follow some examples of possible configurational variants.

Apart from a scraper-like configuration, the cleaning or massaging elements may also take the form of diagonally arranged cleaning or massaging elements of a wing-like or pin-shaped configuration. Also possible are scraper-like cleaning or massaging elements designed in a wavy form in their plan view or bent cleaning or massaging elements that are possibly bent approximately in a circular or crescent-shaped manner. The approximately circular or crescent-shaped cleaning or massaging elements may together or individually form a substantially closed circle or be arranged in segments in a circle.

The soft-elastic cleaning or massaging elements supplement the cleaning effect of the bristles, in that they intensify or bring about the removal of deposits on the teeth and the polishing of the surface of the teeth. Moreover, soft-elastic structures, in particular the soft-elastic cleaning massaging elements, also serve for damping cleaning motions and not least for massaging the gums.

By analogy with how the different types of tufts of bristles can be combined or arranged with one another, covering the toothbrush in an anchor-free manner by means of the carrier element allows very great freedom of design in the arrangement of soft-elastic structures, in particular the cleaning or massaging elements. For example, scraper-like soft-elastic cleaning or massaging elements that are arcuate in their plan view and arranged on a circle may enclose one or more tufts of bristles, the soft-elastic cleaning elements for their part being surrounded or able to be surrounded by tufts of bristles. Moreover, the AFT method allows tufts of bristles with an arcuate cross section, for example, to be realized, since no anchor that restricts the width and form of the tuft of bristles is necessary.

Tufts of bristles according to the invention comprise bristles of at least two different lengths. The bristles with the higher bristle ends thereby form a (second) area of use. This area of use may be a level running substantially parallel to the upper side of the head part. The area of use may, however, also be a level inclined with respect to the upper side of the head part or the area of use may be a, for example, wavy, roof-shaped or jagged profile.

The bristle-carrying head part may have a bristle area which is formed from different types of tufts of bristles. Apart from the tufts of bristles with bristles which have bristle ends standing up to different heights, and consequently form at least two levels of use, there may also be further tufts of bristles with cylindrical bristles or with exclusively pointed bristles. In addition, there may also be soft-elastic structures, for example in the form of soft-elastic cleaning and massaging elements. The soft-elastic structures may be molded directly on the head part or on a carrier element which is inserted into the head part and connected to it. As discussed above, one particular type of soft-elastic structures is formed by the molded bristles.

With respect to the height of the soft-elastic cleaning and massaging elements, or molded bristles, extensive studies show that the ends of these elements are preferably chosen to be deeper than the ends of the stepped tufts of bristles. The ends of these elements are preferably chosen to be deeper than the last step on the used side of the stepped tufts of bristles. With particular preference, the ends of these elements are chosen to be deeper than the lowermost step or area of use of the stepped tufts of bristles.

With respect to the position of the soft-elastic cleaning and massaging elements, or molded bristles, the stepped tufts of bristles are arranged in the periphery of the bristle area. With preference, the soft-elastic cleaning and massaging elements or the molded bristles are arranged between two or more stepped tufts of bristles according to the invention.

It is additionally proposed also to arrange stepped tufts of bristles according to the invention within soft-elastic structures. In this case, the soft-elastic structures surround or support a substantial part along the circumference of the stepped tufts of bristles. In this case, at least 30%, preferably over 50%, of the circumference of the stepped tufts of bristles according to the invention are concerned.

In the case of the AFT method (Anchor Free Tufting), the conventional, cylindrical or pointed bristles or the tufts of bristles are fastened without the aid of an anchor to the head part or to a carrier element, for example a bristle-carrying plate. In the case of a bristle-carrying plate, the bristles are thereby led in tufts by their blunt end, opposite from the free used end, through passages in the bristle-carrying plate, so that an end region of the tufts of bristles projects beyond the underside of the bristle-carrying plate. At this end region of the bristles, projecting beyond the underside of the bristle-carrying plate, said bristles are fastened to the carrier element or to the bristle-carrying plate by melting, adhesive bonding or welding. The bristle-carrying plate, with the conventional bristles fastened therein, is subsequently anchored in a recess of the head region of the toothbrush. Alternatively, the bristle-carrying plate is overmolded in an injection mold with hard or soft material in order to form the brush body.

In the process according to the invention, a mold, which has or consists of a block-like basic body, also known as a die, and a hopper plate, is used in a bristle-providing machine. Running through the die of the mold in a vertical direction is a receiving recess. The cross section of this receiving recess is constant over the entire length of the straight receiving recess in the die. In the receiving recess, a pin, known as a profiled pin, is guided with a sliding fit.

In the region in which they come into contact with bristles, that is to say at their end face, the profiled pins must have a scratch-free, polished surface, with preference a lapped or highly polished surface. The roughness values $R_a$ lie in this case between 0.025 and 0.4, preferably 0.025 and 0.15.

Depending on the form of the recesses present on the end face of the profiled pin, they must have sharp, burr-free edges, since otherwise there is the risk of the bristle filaments becoming wedged or jammed when they are introduced into the bore or during the subsequent further processing. Moreover, it is advantageous if the diameter at the bristle end that lies against the profiled pin is not less than the tolerance range between the profiled pin and the receiving recess.

The diameter of the lowest depression in the profiled pin has the effect that between 1 and 15, preferably between 3 and 8, bristles take on the corresponding profile. That is to say that the specified number of bristles stand higher in the tuft of bristles than the rest. These bristle ends form the bristle ends standing up the highest. If multiple steps are formed, it is so that the last step, i.e. the step to the highest bristle ends standing up higher or the uppermost reduced part of the tuft of bristles, must maintain this minimum dimension.

If more than two steps, i.e. two levels, from the used ends of bristle ends are formed, there is a reduction in the number of bristles per step. Each step contains a maximum of 80%, preferably a maximum of 70%, of the bristles of the previous step. With respect to the previous step, the step respectively contains between 30% and 80%, preferably between 45% and 70%, of bristles. In this way, in the final tuft of bristles, between 5% and 25%, preferably between 10% and 15%, of the bristle ends are higher than the rest, that is to say this number of bristle ends form the uppermost step. In this case, profiled pins which do not have any receiving recess, and so the bristle ends are formed in the known manner, may also be used in the final tuft of bristles.

The higher bristle ends are preferably arranged centrally in the tuft of bristles; the arrangement at the periphery of the contour of the tuft of bristles is a further possibility for arrangement.

The depth of the depression is between 0.5 mm and 5 mm, preferably between 2 mm and 3 mm.

In the process sequence, the die, or the receiving recesses thereof with the associated pins, is/are filled with tufts of cylindrical or pointed bristles from a circular arc of the bristle-providing machine. Wherein the circular arc of the die or of the receiving recess supplies 20 to 50, preferably 35 to 45, bristles per passage. A finished tuft of bristles may comprise both bristles from just one passage and bristles from multiple passages of the circular arc.

There is then the possibility of using a variable circular arc. This allows the number of bristles supplied per passage to be adapted. In this way, on the basis of the starting amount of bristles (100%), a variability of approximately +/−35% can be achieved. Accordingly, receiving recesses of different sizes, which lead to tufts of bristles of different sizes on the toothbrush, may be arranged in a die. After the filling, the hopper plate is placed onto the die in a further station of the bristle-providing machine.

The sliding fit between the die and the profiled pins is configured in such a way that the tips of the pointed bristles have a greater diameter than the tolerance range of the sliding fit. The movement of the profiled pins is restricted in such a way that they are only movable within the die.

On its upper end face, which is located in the die and against which the tips of the bristles lie, the profiled pin is provided, for example, with a blind-hole-like depression, in order to impart to the tuft of bristles concerned in the end form a topography in which some of the bristles have a higher bristle end. The end form of the tufts of bristles is decisively influenced by the form of the end face of the profiled pin. Instead of a blind-hole-like depression, however, any other desired topographies of the end face of the profiled pin are also possible.

The hopper plate is preferably placed onto the die and then, if this is envisaged in the process, a bristle-carrying plate is placed on in such a way that the passage of the bristle-carrying plate that is assigned to this tuft of bristles is in line with the corresponding guiding passage in the hopper plate. The upper side of the bristle-carrying plate thereby comes to lie on the hopper plate, so that the underside of the bristle-carrying plate is exposed in the upward direction. For the sake of completeness, it should be mentioned that this guiding passage of the hopper plate also corresponds on the other hand to the receiving recess. By moving the profiled pin in the upward direction toward the bristle-carrying plate, the bristles are moved downward and, with their blunt end in front, pushed through the hopper plate and the passage until an end region adjoining the blunt end in the cylindrical portion of cylindrical or pointed bristles projects beyond the underside of the bristle-carrying plate. Subsequently, a heated punch, for example, is lowered onto the bristles or into the proximity thereof, so that the end region of the bristles melts and forms on the underside a bristle melt bed at least partially covering the underside, and thereby fastens the bristles to one another and to the bristle-carrying plate.

In an analogous way, as described above, the die of the mold may have a further receiving recess with profiled pins guided therein. Bristles, for example cylindrical bristles, are in turn introduced into said recess; these bristles come to lie with their possibly previously machined ends against the end face of the further profiled pins. Depending on the form of the end face of the profiled pins, a topography, that is to say a bristle area with bristle ends standing up to different heights, is in turn thereby produced.

At the same time as the profiled pin described above, the further profiled pins are displaced, in order to push the tufts of bristles through the further passages of the bristle-carrying plate, until the tufts of bristles project with an end portion beyond the underside of the bristle-carrying plate. The melting of the end portions takes place as described above or in another known way.

If different plastics are used for the production of the cylindrical or pointed bristles, a bristle melt bed of the corresponding plastics is produced. In particular, this bristle melt bed may consist of polyester (pointed bristles) and polyamide(cylindrical bristle). Since these two types of plastic do not bond together in the bristle melt, with preference it must be ensured that the individual materials are used to form groups of tufts of bristles in which the bristle melt within one group can bond together. In this respect, the tufts of bristles of the same type are preferably placed in groups in direct proximity. In this case, the tufts of bristles comprising pointed bristles or cylindrical bristles are consequently preferably introduced into receiving recesses or further receiving recesses which are arranged adjacently and form a group.

The present invention may be used for bristle areas of various products. For example, manual toothbrushes, electric toothbrushes with rotating, oscillating, swivelling or translatory motion (as sideward or longitudinal movement), vibrating motion or a combination of these motions may be equipped with tufts of bristles which have bristles with at least two bristle ends standing up to different heights.

It is expressly pointed out at this stage that, apart from the stepped tufts of bristles, the bristle area may also have all, only some or none of the cleaning elements additionally described (such as, for example, soft-elastic cleaning and massaging elements, molded bristles, simple tufts without steps). The arrangement and height of the additional cleaning elements or tufts has a major influence on the overall cleaning performance of the bristle area.

The invention is now described in more detail on the basis of exemplary embodiments that are represented in the purely schematic figures, in which.

FIG. 6*a* shows a section through a mold with a receiving recess for the pointed bristles and a further receiving recess for cylindrical bristles, a pin guided in the receiving recess and a further pin guided in the further receiving recess, for the movement and alignment of the bristles, a bristle-carrying plate arranged on the hopper plate, wherein the hopper plate directs the pointed and cylindrical bristles to a common passage of the bristle-carrying plate, and a heated punch;

FIG. 6*b* shows a plan view of the die from FIG. 6*a;*

FIG. 6*c* shows a plan view of the hopper plate from FIG. 6*a;*

Figures 7A, 7B, 7C, 8A, 8B, 8C, 9A, 9B, 9C:
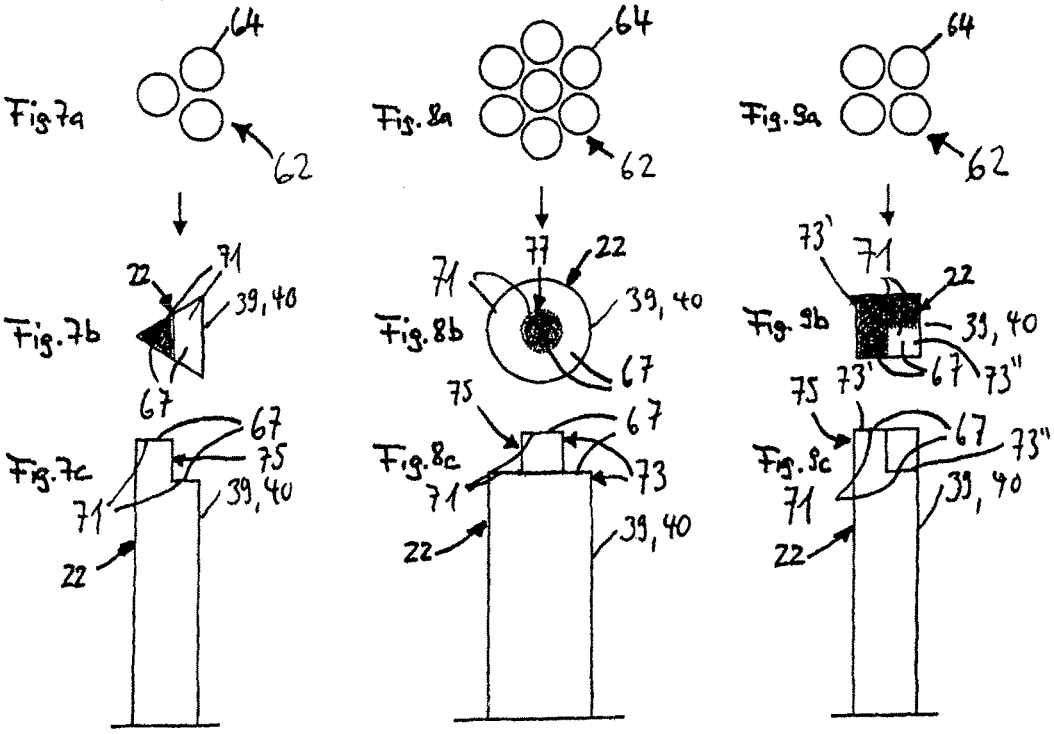

FIG. 7*a* shows a plan view of the receiving recesses for bristles in a die;

FIG. 7*b* shows a plan view of the finished tuft of bristles produced with a die according to FIG. 7*a;*

FIG. 7*c* shows a side view of the finished tuft of bristles from FIG. 7*b;*

FIG. 8*a* shows a plan view of the receiving recesses for bristles and a further die;

FIG. 8*b* shows a plan view of the finished tuft of bristles produced with a die according to FIG. 8*a;*

FIG. 8*c* shows a side view of the finished tuft of bristles from FIG. 8*b;*

FIG. 9*a* shows a plan view of the receiving recesses for bristles in a further die;

FIG. 9*b* shows a plan view of the finished tuft of bristles produced with a die according to FIG. 9*a;*

FIG. 9*c* shows a side view of the finished tuft of bristles from FIG. 9*b;*

Figures 10A, 10B, 10C, 10D, 10E, 11A, 11B, 11C, 11D, 11E:
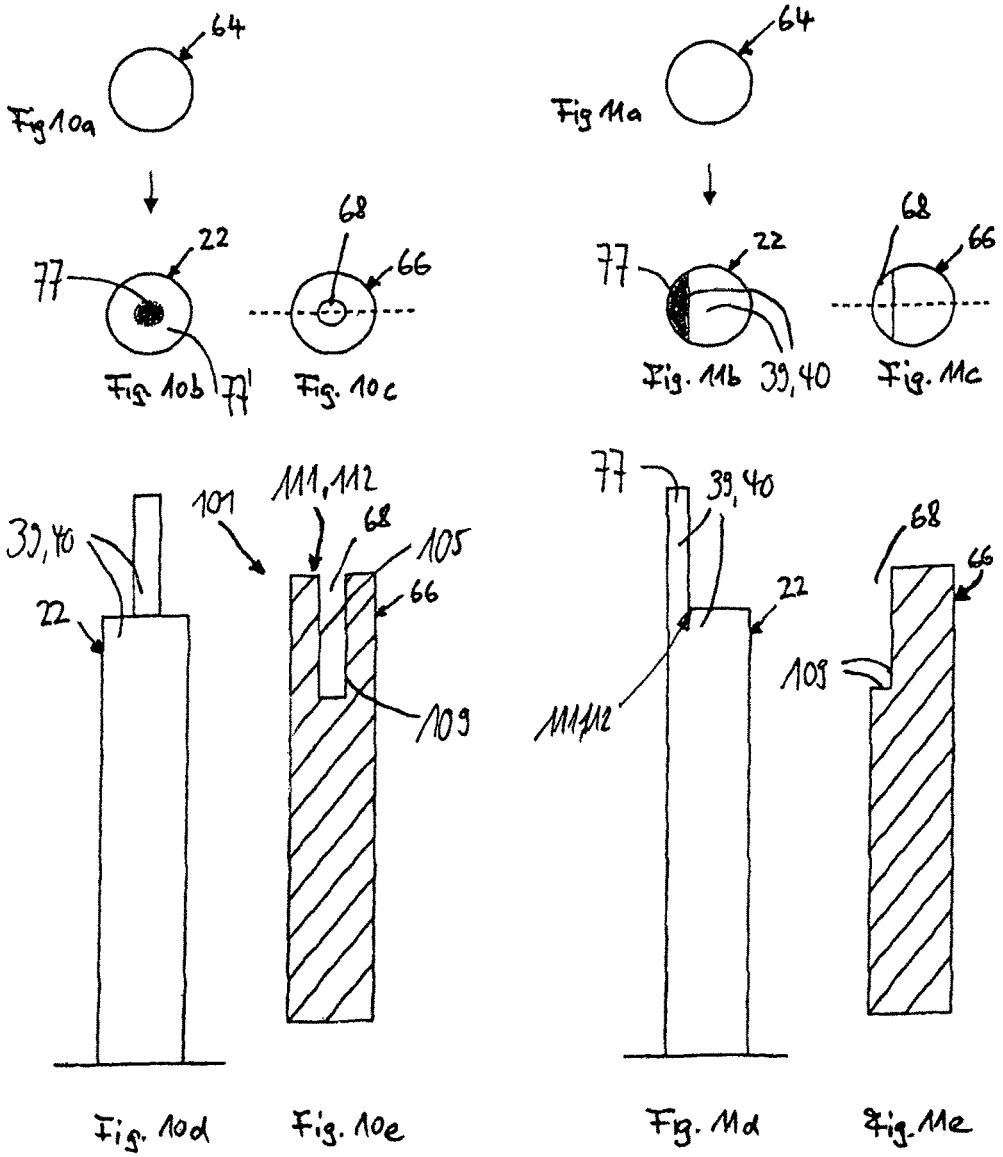

FIG. 10*a* shows a plan view of a receiving recess for bristles in a die;

FIG. 10*b* shows a plan view of the finished tuft of bristles according to FIG. 10*a;*

FIG. 10*c* shows a plan view of the corresponding profiled pin for the production of a tuft of bristles according to FIG. 10*b;*

FIG. 10*d* shows a side view of the tuft of bristles produced according to FIGS. 10*a* to 10*c;*

FIG. 10*e* shows a side view of the profiled pin from FIG. 10*c;*

FIG. 11*a* shows a plan view of a receiving recess for bristles in a die;

FIG. 11*b* shows a plan view of the finished tuft of Bristles according to FIG. 11*a;*

FIG. 11*c* shows a plan view of the corresponding profiled pin for the production of the tuft of bristles according to FIG. 11*b;*

FIG. 11*d* shows a side view of the tuft of bristles produced according to FIGS. 11*a* to 11*c;*

FIG. 11*e* shows a side view of the profiled pin from FIG. 11*c;*

Figures 12A, 12B, 12C, 12D, 12E, 13, 14, 15:
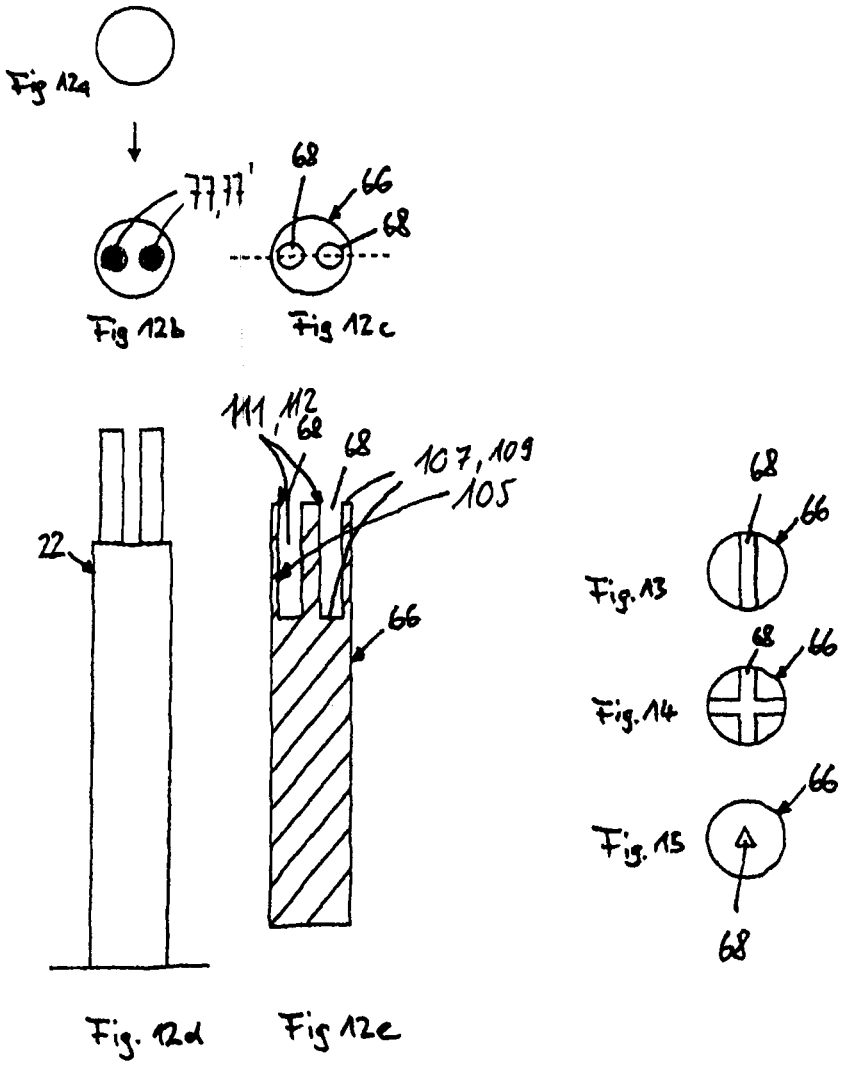

FIG. 12*a* shows a plan view of a receiving recess for bristles in a die;

FIG. 12*b* shows a plan view of the finished tuft of bristles;

FIG. 12*c* shows a plan view of the corresponding profiled pin for the production of a tuft of bristles according to FIG. 12*b;*

FIG. 12*d* shows a side view of the tuft of bristles produced according to FIGS. 12*a* to *c;*

FIG. 12*e* shows a side view of the profiled pin from FIG. 11*c;*

Figures 16A, 16B, 16C, 16D, 17A, 17B, 17C, 17D, 18A, 18B, 18C, 18D:
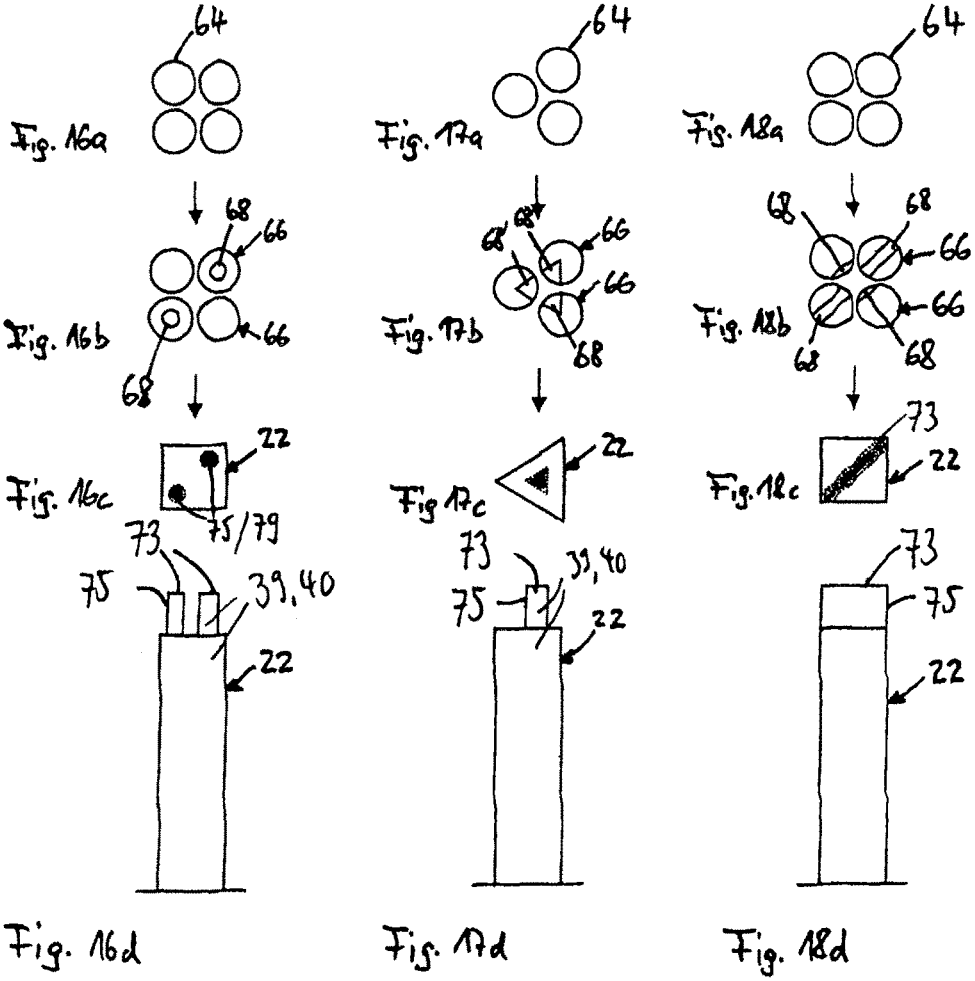

FIG. 13 shows a plan view of a further possible profiled pin;

FIG. 14 shows a plan view of a further possible profiled pin;

FIG. 15 shows a plan view of a further possible profiled pin;

FIG. 16*a* shows a plan view of the receiving recesses of a die;

FIG. 16*b* shows a plan view of the profiled pins assigned to the receiving recesses according to FIG. 16*a;*

FIG. 16*c* shows a plan view of the finished tuft of bristles produced by means of the profiled pins produced according to FIG. 16*b;*

FIG. 16*d* shows a side view of the finished tuft of bristles produced by means of the profiled pins according to FIG. 16*b;*

FIG. 17*a* shows a plan view of the receiving recesses of a die;

FIG. 17*b* shows a plan view of the profiled pins assigned to the receiving recesses according to FIG. 17*a;*

FIG. 17*c* shows a plan view of the finished tuft of bristles produced by means of the profiled pins according to FIG. 17*b;*

FIG. 17*d* shows a side view of the finished tuft of bristles produced by means of the profiled pins according to FIG. 17*b;*

FIG. 18*a* shows a plan view of the receiving recesses of a die;

FIG. 18*b* shows a plan view of the profiled pins assigned to the receiving recesses according to FIG. 18*a;*

FIG. 18*c* shows a plan view of the finished tuft of bristles produced by means of the profiled pins according to FIG. 18*b;*

FIG. 18*d* shows a side view of the finished tuft of bristles produced by means of the profiled pins according to FIG. 16*b;*

Figures 19A, 19B, 19C, 19D, 19E:
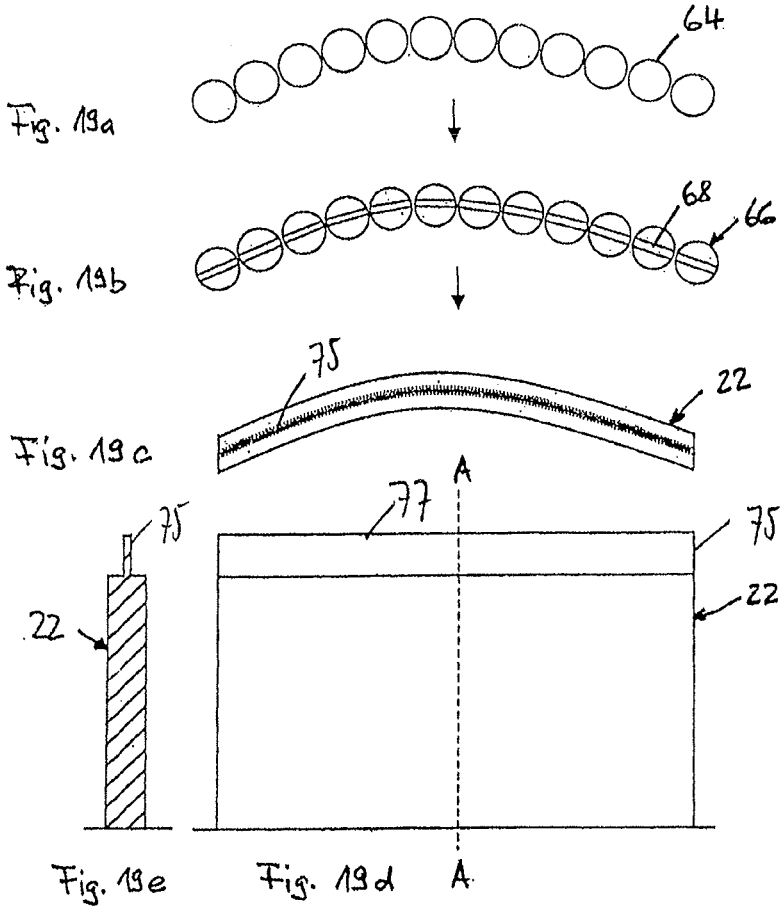

FIG. 19*a* shows a plan view of the receiving recesses of a die;

FIG. 19*b* shows a plan view of the profiled pins assigned to the receiving recesses according to FIG. 19*a;*

FIG. 19*c* shows a plan view of the finished tuft of bristles, produced by means of the profiled pins according to FIG. 19*b;*

FIG. 19*d* shows a side view of the finished tuft of bristles, produced by means of the profiled pins according to FIG. 19*b;*

Figures 20A, 20B, 20C, 20D, 20E:
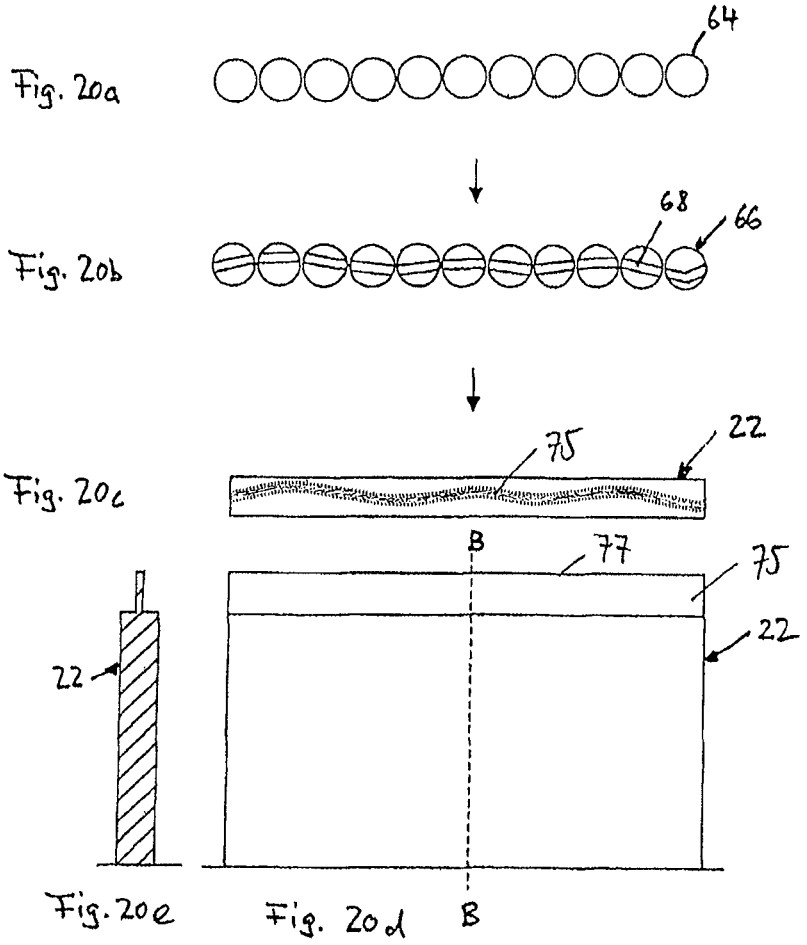

FIG. 19*e* shows a cross-section through the tuft of bristles according to FIG. 19*d* along the line A-A;

FIG. 20*a* shows a plan view of the receiving recesses of a die;

FIG. 20*b* shows a plan view of the profiled pins assigned to the receiving recesses according to FIG. 20*a;*

FIG. 20*c* shows a plan view of the finished tuft of bristles, produced by means of the profiled pins according to FIG. 20*b;*

FIG. 20*d* shows a side view of the finished tuft of bristles, produced by means of the profiled pins according to FIG. 20*b;*

Figure 21A:
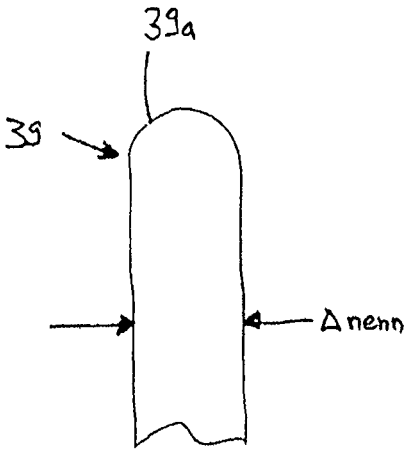
Figure 21B:
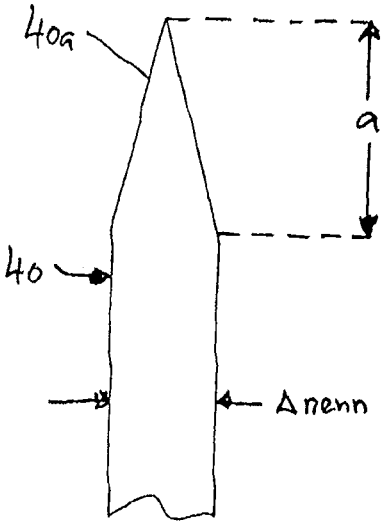

FIG. 20*e* shows a cross section through the tuft of bristles according to FIG. 20*d* along the line B-B;

FIG. 21*a* shows the form of the end region of a cylindrical rounded-off bristle; and FIG. 21*b* shows the form of the end region of a pointed bristle;

FIG. 22*a* shows a plan view of the receiving recesses of a die;

FIG. 22*b* shows a plan view of the profiled pins assigned to the receiving recesses according to FIG. 22*a;*

FIG. 22*c* shows a plan view of the finished tuft of bristles, produced by means of the profiled pins according to FIG. 22*b;*

FIG. 22*d* shows a side view of the finished tuft of bristles, produced by means of the profiled pins according to FIG. 22*b;*

Figures 23A, 23B, 23C, 23D, 23E:
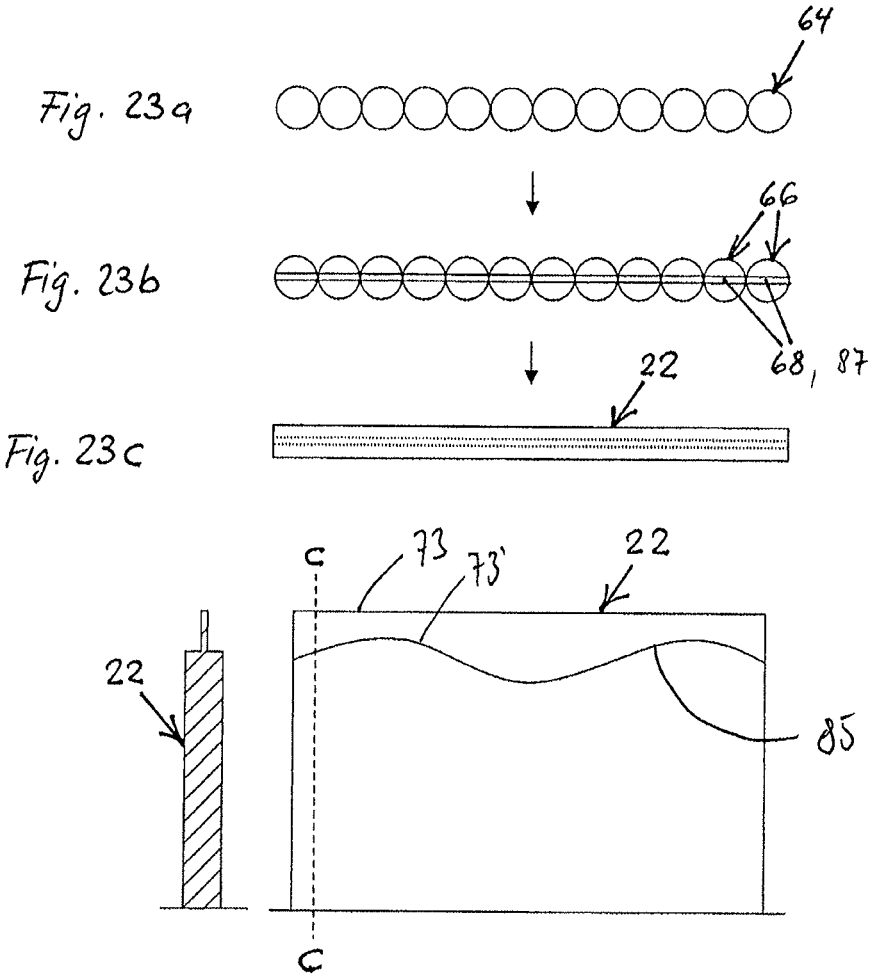

FIG. 22*e* shows a side view of the finished tuft of bristles, produced by means of the profiled pins according to FIG. 22*b*, in a further configurational variant;

FIG. 22*f* shows a side view of the finished tuft of bristles, produced by means of the profiled pins according to FIG. 22*b*, in a further configurational variant;

FIG. 22*g* shows a side view of the finished tuft of bristles, produced by means of the profiled pins according to FIG. 22*b*, in a further configurational variant;

FIG. 23*a* shows a plan view of the receiving recesses of a die;

FIG. 23*b* shows a plan view of the profiled pins assigned to the receiving recesses according to FIG. 23*a;*

FIG. 23*c* shows a plan view of the finished tuft of bristles, produced by means of the profiled pins according to FIG. 23*b;*

FIG. 23*d* shows a side view of the finished tuft of bristles, produced by means of the profiled pairs according to FIG. 23*b;*

FIG. 23*e* shows a cross-section through the tuft of bristles according to FIG. 23*d* along the line C-C;

FIG. 24*a* shows a plan view of the receiving recesses of a die;

FIG. 24*b* shows a plan view of the profiled pins assigned to the receiving recesses according to FIG. 24*a;*

FIG. 24*c* shows a plan view of the finished tuft of bristles, produced by means of the profiled pins according to FIG. 24*b;*

FIG. 24*d* shows a side view of the finished tuft of bristles, produced by means of the profiled pins according to FIG. 24*b;*

FIG. 24*e* shows a cross-section through the tuft of bristles according to FIG. 24*d* along the line D-D;

FIG. 25*a* shows a plan view of the receiving recesses of a die;

FIG. 25*b* shows a plan view of the profiled pins assigned to the receiving recesses according to FIG. 25*a;*

FIG. 25*c* shows a plan view of the finished tufts of bristles, produced by means of the profiled pins according to FIG. 25*b;*

FIG. 25*d* shows a side view of the finished tufts of bristles, produced by means of the profiled pins according to FIG. 25*b;*

FIG. 25*e* shows a cross section through a tuft of bristles according to FIG. 25*d* along the line E-E;

FIG. 26*a* shows a plan view of the receiving recesses of a die;

FIG. 26*b* shows a plan view of the profiled pins assigned to the receiving recesses according to FIG. 26*a;*

FIG. 26*c* shows a plan view of the finished tuft of bristles, produced by means of the profiled pins according to FIG. 26*b;*

FIG. 26*d* shows a side view of the finished tuft of bristles, produced by means of the profiled pins according to FIG. 26*b;*

FIG. 27*a* shows a plan view of the receiving recesses of a die;

FIG. 27*b* shows a plan view of the profiled pins assigned to the receiving recesses according to FIG. 27*a;*

FIG. 27*c* shows a plan view of the finished tufts of bristles, produced by means of the profiled pins according to FIG. 24*b;*

FIG. 27*d* shows a side view of the finished tufts of bristles, produced by means of the profiled pins according to FIG. 24*b;*

Figure 29:
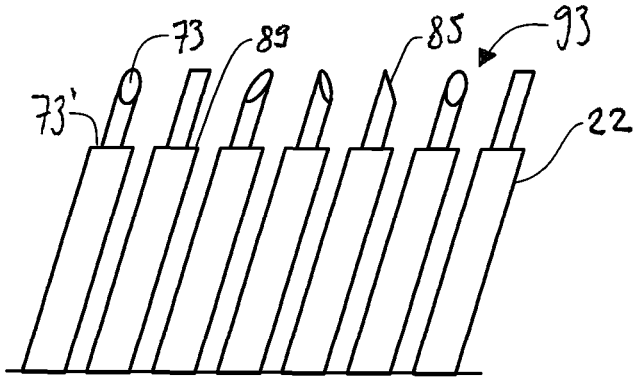

FIG. 28*a* shows a side view of tufts of bristles according to the invention in combination with massaging and cleaning elements;

FIG. 28*b* shows a side view of further tufts of bristles according to the invention in combination with massaging and cleaning elements; and FIG. 29 shows a side view of further tufts of bristles according to the invention.

Figure 1:
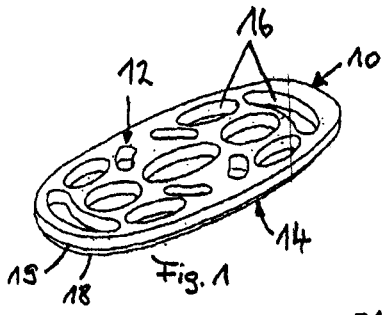
FIG. 1 shows a carrier element in the form of a bristle-carrying plate in a perspective view.

FIG. 1 shows a possible carrier element in the form of a bristle-carrying plate 10 in a perspective view as seen obliquely from above. A number of passages 16 extend from the upper side 12 thereof to the underside 14. In the example shown, these passages have a kidney-shaped or oval cross section. The passages may also have a circular or any other desired cross section. An annular centering bead 18 projects downward from the underside 14 and extends along the side edge of the bristle-carrying plate 10, at a small distance from it, and is preferably tapered in a wedge-shaped manner in the direction of the free end. A peripheral welding edge 19 running along the side edge of the bristle-carrying plate 10 between the centering bead 18 and the side edge of the bristle-carrying plate 10 is provided on the underside 14 thereof, directly alongside the centering bead 18. This welding edge is used for connecting the bristle-carrying plate 10 and the toothbrush body 28. It goes without saying that the welding edge 19 may also be provided at any other desired location to the side of, or on the underside of, the bristle-carrying plate 10. In particular, it is also possible to provide the welding edge on the centering bead 18. These alternative arrangements of the welding edge of course require adaptations to the corresponding geometry of the bristle-carrying plate 10, that is to say to the recess 32.

Alternatively, the bristle-carrying plate 10 with the bristles inserted may also be inserted once again into an injection mold and the handle or the handle region can subsequently be formed by means of overmolding at least part of the bristle-carrying plate 10 from one or more plastics components.

Figure 2:
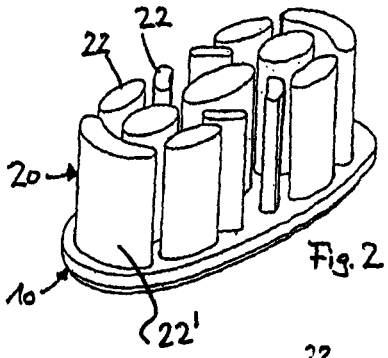
FIG. 2 shows the bristle-carrying plate with a bristle area, likewise in a perspective view.

FIG. 2 shows in the same manner of representation as FIG. 1 the bristle-carrying plate 10, which is provided with a schematically indicated covering of bristles 20. The covering of bristles 20 consists of tufts of bristles 22, that is to say one tuft of bristles 22 for each passage 16. Each of the tufts of bristles 22 consists of a multiplicity of bristles 39, 40; these are described in detail hereinbelow. The tuft of bristles 22' located in the front region of the bristle-carrying plate 10 form a power tip.

Figure 3:
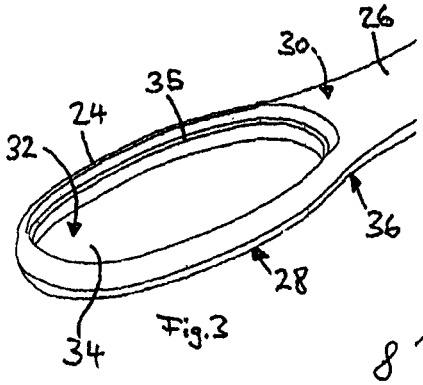
FIG. 3 shows a head region and part of a neck region of a toothbrush body with a recess in the head region, likewise in a perspective view.

FIG. 3 shows a head region 24 and part of a neck region 26, adjoining thereto, of a toothbrush body 28.

The neck region 26 is adjoined in a generally known manner, at the end which is facing away from the head region 24, by the handle region. The head region 24 is provided from its front side 30, which is lying upward in FIG. 3, with a recess 32, which corresponds substantially to the form of the bristle-carrying plate 10 and is bounded by a base 34. The side wall of this recess 32 has a peripheral shoulder which forms a welding ledge 35. The rear side 36 of the toothbrush body 28 is located on the side opposite from the front side 30 and is at the bottom in the view shown.

Figure 4:
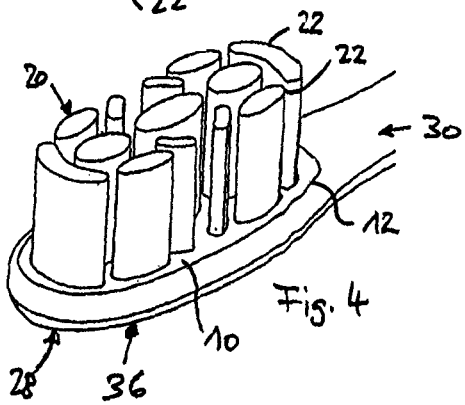
FIG. 4 shows the toothbrush body from FIG. 3, with the bristle-carrying plate from FIG. 2, carrying bristles and inserted into the recess, in a perspective view.

FIG. 4 shows the bristle-carrying plate 10 provided with the covering of bristles 20 inserted into the recess 32. The insertion is simplified by the centering bead 18. In the finished state of the toothbrush, the upper side 12 of the bristle-carrying plate 10 is preferably in line with the front side 30 of the toothbrush body 28. The bristle-carrying plate 10 is fixedly connected to the toothbrush body 28, preferably by means of ultrasonic welding. Welding is carried out here in the region of the welding edge 19 and the welding ledge 35. The covering of bristles 20 projects beyond the upper side 12. FIG. 4 thus shows the head region and part of the neck region of a toothbrush 28. Of course, it is also possible to use other methods here for anchoring the bristles or bristle-carrying plate, such as, for example, adhesive bonding, caulking or overmolding.

The bristle-carrying plate 10 is preferably produced from a hard component, such as that already described further above.

In the example shown, the head region 24 and the neck region 26 of the toothbrush body 28 are also produced at least from one of these hard components. Use is preferably made of the same hard component for the bristle-carrying plate 10 and the toothbrush body 28, at least in the region of contact between the two parts.

For the sake of completeness, however, is should be mentioned here that both the bristle-carrying plate 10 and the toothbrush body 28 may be produced by multi-component injection molding. It is possible here for both the bristle-carrying plate 10 and the toothbrush body 28 each to be constructed from one or more hard components and/or from one or more soft components. A summary of possible hard and soft components is given further above in this document.

If the bristle-carrying plate 10 consists of one or more hard components and one or more soft components, the passages 16 are preferably arranged in the hard component. The soft component can not only be used for forming additional soft-elastic cleaning elements or molded bristles on the bristle-carrying plate 10 or on the head region 24 but also be provided on the toothbrush body 28 for functional, haptic or decorative purposes.

Figure 5:
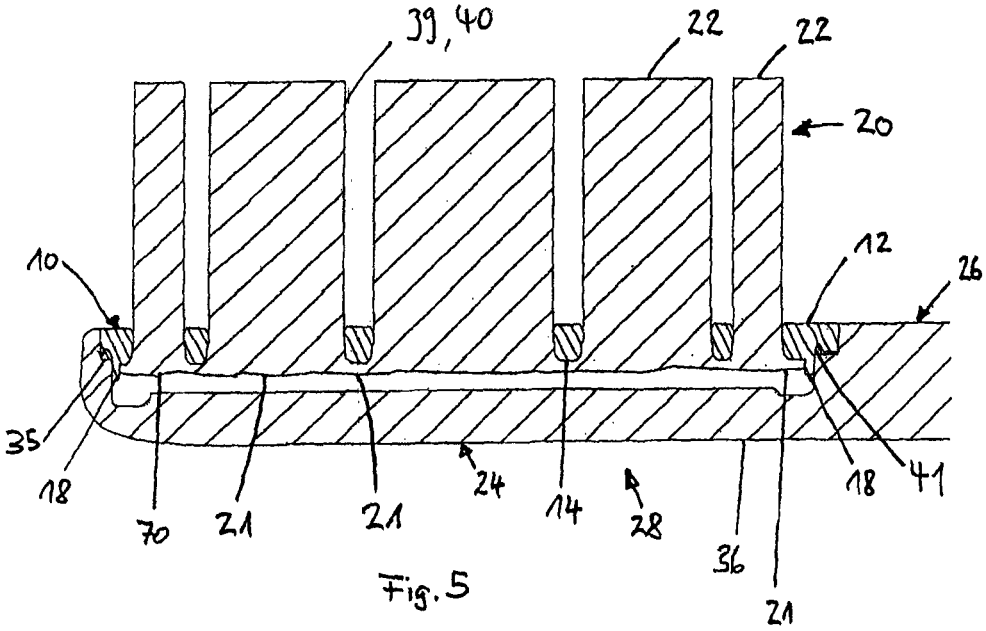
FIG. 5 shows the completely assembled brush head from FIG. 4 in longitudinal section.

FIG. 5 shows a longitudinal section along a central longitudinal plane, this central longitudinal plane being perpendicular to the front side 30 of the head part 24. The central longitudinal plane or the sectional plane in this case runs through the five tufts of bristles 22 shown in FIG. 4 and arranged centrally in the transverse direction of the toothbrush. The bristles 39, 40 are not shown individually in detail but are schematically represented in tufts as an area or volume. The melted end regions 70 form an easily recognizable bristle melt bed 21, which in the embodiment shown extends over virtually the entire underside 14 of the bristle-carrying plate 10.

The bristle melt bed 21 may be subdivided into different segments and thereby cover only individual groups of tufts of bristles 22.

The bristle-carrying plate 10 is fixedly connected by means of its welding edge 19 to the welding ledge 35 of the head part 24. A welding region 41 is schematically represented in FIG. 5 by a line as a delimitation. Arranged adjacent the head part 24 and fixedly connected to it is the neck part 26 of the toothbrush body 28.

FIG. 6*a* shows one possibility for providing a bristle-carrying plate 10 with a tuft of bristles 22, which has both conventional, pointed bristles 40 and conventional, cylindrical bristles 39. The die 62 has a receiving recess 64, into which pointed bristles 40 are introduced, and right alongside a further receiving recess 64', into which cylindrical bristles 39 are, or have been, introduced.

The guiding passages 69 and 69', assigned to these receiving recesses 64 and 64', of a hopper plate 63 arranged on the die 62 run toward one another, in the direction of the bristle-carrying plate 10 arranged on the hopper plate 63, in such a way that, at the end on this side, they form a single common outlet for the bristles 40 and 39. It is also possible that the two passages 69 and 69' also form separate outlets, which however lie directly next to one another. The outlet or the outlets lying directly next to one another is/are in line with a passage 16 of the bristle-carrying plate 10 that is shared by the bristles 40 and 39.

Guided in the receiving recess 64 and in the further receiving recess 64' is a respective profiled pin 66, 66'. When the pins 66, 66' move simultaneously in the direction of the hopper plate 63, the tuft 22 of pointed bristles 40 and the tuft 22 of cylindrical bristles 39 are pushed through the common passage of the bristle-carrier plate 10 until the end region 70, 70' thereof projects beyond the underside 14 of the bristle-carrying plate 10 that is lying upward here. Subsequent melting of the end region 70 and 70', for example by means of the heated punch 72, has the effect that the bristles 40, 39 are fastened to the bristle-carrying plate 10; the bristle melt bed 21 forms.

In a corresponding way it is possible to bring together multiple individual tufts 22 of bristles 39, 40 from different receiving recesses 64 by means of a hopper plate 63, and consequently together form a cluster of bristles in a common passage 16. In this way, as shown in FIG. 5, it is also possible to feed tufts 22 of bristles 40 or 39 of the same type to a common passage 16.

The bristle-carrying plate 10 provided with the covering of bristles 20 is removed from the mold 60 and brought together with the toothbrush body 28 in a way known from the prior art and is fastened there.

As already described, in bristle-providing processes without bristle-carrying plates 10, the bristles 40, 39 are led into a mold cavity instead of through the bristle-carrying plate 10. In this mold cavity, plastics material is subsequently injected in order to form the brush head and anchor the bristles 40, 39 in this way. This alternative production process without a carrier plate may be applied to all the described embodiments of this document.

FIG. 6*b* shows a plan view of a detail of the die 62 with the receiving recesses 64 and 64'. The guiding passages 69 and 69' assigned to the receiving recesses 64, 64' come together on the side of the hopper plate 63 that is facing the bristle-carrying plate 10 to form a single common outlet 65, as shown in FIG. 6*c*. In this case it is so that the sum of the cross-sectional areas from FIG. 6*b*, which together form a tuft of bristles 22, is of substantially the same size as the cross-sectional area of the common outlet 65.

FIGS. 7*a-c*, 8*a-c* and 9*a-c* respectively show a possible produced tuft of bristles 22 with bristles 39, 40, which have a higher bristle end, and consequently form in this example two different areas of use 67. By analogy, with further steps in the profiled pins 66 it is of course also possible to produce three or more areas of use.

The tufts of bristles 22 shown are made up by bristles 39, 40 from multiple receiving recesses 64. In this case, the tufts of bristles 22 or the higher parts thereof are respectively configured by one receiving recess 64 or a single profiled pin 66. This means that all the bristles that originate from one receiving recess 64 are of the same length in the final product.

The receiving recesses 64 and the corresponding profiled pins 66 are in each case of a circular configuration, while the corresponding final tuft of bristles 22 may be of various forms (circular, elliptical, rectangular, square, trapezoidal, crescent-shaped, free-formed, etc.).

The final tufts of bristles 22 have bristles 39, 40 from 1 to 15, preferably 1-7, receiving recesses 64. The receiving recesses 64 that belong to one final tuft of bristles 22 may have 2 or more different diameters, and consequently different cross-sectional areas. The ratio of the cross-sectional area of the smallest to the largest receiving recess 64 for a final tuft 22 is 1:3; this is explained in more detail in conjunction with FIGS. 26*a* to 26*d*.

By skilful adaptation of the diameters of the different receiving recesses 64, the number of bristles 39, 40 of the different heights, or the end areas or areas of use 67, can be determined. This process consequently also allows different types of bristle to be brought together within the receiving recesses 64 for a final tuft of bristles 22. For example, pointed bristles 40 may be inserted in some of the receiving recesses 64 and conventional cylindrical bristles 39 may be inserted in some other of the receiving recesses 64. Consequently, the different end regions 71 of the final tuft 22 are formed with the different types of bristle. The same applies to bristles 39, 40 of different color and/or different diameter and/or bristles 39, 40 with differently colored end regions 71. Since, in the case of this process, multiple receiving recesses 64 are used, it tends to be used for larger tufts with more than 40 bristles.

In FIGS. 7*a*, 8*a* and 9*a*, the corresponding arrangement of receiving recesses 64 of the die 62 are shown. In FIG. 7*a*, the receiving recesses 64 are arranged at the points of an equilateral triangle. In FIG. 7*b*, a plan view of the finished tuft of bristles 22 can be seen, the part of the tuft of bristles 22 that has bristles 39, 40 with higher bristle ends 73 being shown in gray and originating from the receiving recess 64 that is arranged on the left in FIG. 7*a*. The tuft of bristles 22 has in its plan view the form of an equilateral triangle, the higher part 75 of the tuft of bristles 22 extending toward one point of the triangle. In FIG. 7*c*, a side view of the tuft of bristles 22 from FIG. 7*b* is shown.

FIG. 8*a* shows 7 receiving recesses 64, which are arranged at the corner points and in the center of a regular hexagon. In FIG. 8*b*, a substantially circular (it may also be elliptical) tuft of bristles 22 is shown, with a centrally arranged higher bristle tuft part 77 shown in gray. The higher bristle tuft part 77 is formed by the middle recess 64 (FIG. 8*a*). FIG. 8*c* shows a side view of the tuft of bristles represented in FIG. 8*b*.

A further possible embodiment of a tuft of bristles 22 is shown in FIG. 9*b*. The tuft of bristles 22 has a rectangular or square form and the receiving recesses in FIG. 9*a* are arranged correspondingly at the corner points of a square. In this case, three of the four parts of the tuft of bristles divided into squares have bristles with a higher bristle end 73'. The receiving recess 64 lying at the bottom right in FIG. 9*a* in this case receives the bristles 39, 40 with the lower-lying bristle ends 73". FIG. 9*c* shows a side view of the tuft of bristles 22 represented in FIG. 9*b*.

In FIGS. 7*a-c* and 8*a-c*, tufts of bristles 22 in which the smaller proportion of the overall cross section stands up higher are shown. In FIGS. 9*a-c*, the opposite situation is represented. The greater proportion of the cross section is made higher and a smaller proportion is lower.

In FIGS. 7*a-c* and FIGS. 8*a-c*, a further detail is highlighted. The higher parts 75 of the tufts of bristles 22 may be arranged both at the periphery of the tuft of bristles 22 and also in the middle, surrounded by lower bristles 39, 40, in the tuft of bristles 22. It goes without saying that the same is also possible with lower parts of a tuft of bristles 22.

FIGS. 10*a-e* show a further possible configuration of an individual tuft of bristles 22, which is produced from bristles 39, 40 that originate from only a single receiving recess 64. FIG. 10*a* shows the receiving recess 64 of the die 62. The tuft of bristles 22 represented in FIG. 10*b* has in plan view a circular form with a centrally arranged raised bristle tuft part 77 shown in gray. The corresponding side view of the tuft of bristles is depicted in FIG. 10*d*.

FIG. 10*c* shows a plan view of the profiled pin 66 corresponding to the tuft of bristles 22. As can be seen from FIG. 10*e*, the profiled pin 66 has a depression 68 corresponding to the raised bristle tuft part 77. The circular form of the depression 68 has a diameter of from 0.3 mm to 0.8 mm, with preference 0.5 mm. This embodiment shows the variant in which the higher bristle tuft part 77 is completely surrounded by the lower bristle tuft part 77'.

In the case of this embodiment with only a single receiving recess 64, the mixing of different types of bristle (color, diameter, end region, pointed or conventional) for the final tuft 22 is not possible. This process is used in particular for fine tufts of bristles 22 with fewer than 70 bristles.

FIGS. 11*a-e* show a further possible configuration of an individual tuft of bristles 22 which is produced from bristles 39, 40 that originate from only one receiving recess 64. FIG. 11*a* shows the receiving recess 64 of the die 62. The tuft of bristles 22 represented in FIG. 11*b* has in turn in plan view a circular form with a circular-segmental raised bristle tuft part 77 shown in gray. The raised bristle tuft part 77 is delimited on the one hand by the circular arc of the circumference of the tuft of bristles 22 and on the other hand by a secant. The corresponding side view of the tuft of bristles is depicted in FIG. 11*d*.

FIG. 11*c* shows a plan view of the profiled' pin 66 corresponding to the tuft of bristles 22. As can be seen from FIG. 11*e*, the profiled pin 66 has a depression 68 corresponding to the raised bristle tuft part 77. In this case, the depression 68 is delimited in certain parts by the receiving recess 64, since, as is known, the profiled pin 66 is guided in the receiving recess 64. This embodiment shows the variant in which the higher bristle tuft part 77 lies partially at the periphery of the tuft of bristles 22 and, on the other hand, is surrounded by the lower bristle tuft part 77.

FIGS. 12*a-e* show a further possible configuration of a tuft of bristles 22. FIG. 12*a* shows the receiving recess 64 of the die 62. The tuft of bristles 22 represented in FIG. 12*b* has in plan view a circular form with a raised bristle tuft part 77 shown in gray. As a difference from the configurations presented above, the tuft of bristles 22 represented in FIGS. 12*b* and 12*d* in plan view and side view, respectively, has not just one but two higher bristle tuft parts 77, 77' in the same tuft of bristles 22. Like the tuft of bristles 22 itself, the two higher bristle tuft parts 77, 77' have a circular form and are arranged symmetrically on a diametral line of the tuft of bristles.

FIG. 12*c* shows a plan view of the profiled pin 66 corresponding to the tuft of bristles. As can be seen from FIG. 12*e*, the profiled pin 66 has two depressions 68 corresponding to the raised bristle tuft part 77.

The example is intended to show that multiple raised bristle tuft parts 77, 77' may be formed in one tuft of bristles 22. Not shown here is a variant where the higher bristle tuft part 77, 77' on the one hand may have different bristle lengths within the same higher bristle tuft part 77, 77'. On the other hand, it goes without saying that the higher bristle tuft parts 77, 77' as a whole may have different bristle lengths.

FIGS. 13, 14 and 15 show further embodiments of profiled pins 66 given by way of example, each with a differently formed depression 68. While the profiled pin 66 according to FIG. 13 has a groove-shaped depression 68 running along a diametral line of the circular profiled pin 66, the profiled pin 66 shown in FIG. 14 has a cross-recessed depression 68. The profiled pin 66 depicted in FIG. 15 has a centrally arranged triangular depression 68. It is clear from the configurations of profiled pins 66 presented by way of example that almost any desired configurations of the tufts of bristles 22 with respect to their higher parts are possible, in particular with respect to the cross sections thereof.

FIGS. 16*a-d* show a further embodiment of a tuft of bristles 22 with bristles 39, 40, of which at least some have a higher bristle end 73'. FIG. 16*a* shows the four receiving recesses 64 of the die 62 that correspond to the tuft of bristles 22 and are arranged at the corner points of a square. Of the profiled pins 66 that are assigned to the receiving recesses 64 and are shown in FIG. 16*b*, two (lying diagonally opposite) have a centrally arranged depression 68. Accordingly, in the plan view of the finished tuft of bristles 22 that is shown in FIG. 16*c*, two regions 79 shown in gray can be seen on a diagonal of the square tuft of bristles 22 with higher bristle ends 73. FIG. 16*d* shows the finished tuft of bristles 22 in side view. The higher parts 75 of the tuft of bristles 22 are achieved in this embodiment by multiple profiled pins 66. The recess in the profiled pin 66 is respectively assigned to a higher part 75.

FIGS. 17*a-d* show a further configuration of a tuft of bristles 22 with bristles of which at least some have a higher bristle end 73. FIG. 17*a* shows the three receiving recesses 64 of the die 62 that correspond to the tuft of bristles 22; they are arranged at the corners of an equilateral triangle. Of the profiled pins 66 that are assigned to the receiving recesses 64 and are shown in FIG. 17*b*, all have a circular-sector-shaped depression 68, respectively facing the other two profiled pins 66. Accordingly, in the plan view of the finished tuft of bristles 22 that is shown in FIG. 17*c*, a triangular region of the tuft of bristles 22, shown in gray, with higher bristle ends 73 can be seen. The triangular higher part 75 of the tuft of bristles 22 is arranged centrally in the likewise triangular tuft of bristles 22. FIG. 17*d* shows the finished tuft of bristles 22 in side view. The higher part of the tuft of bristles 22 is achieved in this embodiment by multiple profiled pins 66. Here, the circular-sector-shaped depressions 68 of the individual profiled pins 66 each represent only one part, parts which together as a whole ultimately form the raised part of the tuft of bristles 22.

FIGS. 18*a-d* represent a further embodiment of a tuft of bristles 22 with bristles of which at least some have a higher bristle end 73. FIG. 18*a* shows the four receiving recesses 64 of the die corresponding to the tuft of bristles 22, these recesses being arranged at the corner points of a square. Of the profiled pins 66 assigned to the receiving recesses 64 and shown in FIG. 18*b*, two (lying diagonally opposite) have a groove-shaped depression 68 running along a diametral line (diagonal), whereas the depressions 68 of the other two profiled pins 66 are each circular-segmental. In the plan view of the finished tuft of bristles 22 that is shown in FIG. 18*c*, the raised regions of the tuft of bristles 22 that complement the depressions of the profiled pins 66 create a ridge running diagonally over the square tuft of bristles 22. FIG. 18*d* shows the finished tuft of bristles in side view. The higher parts 75 of the finished tuft of bristles 22 are achieved in this embodiment by the combination of depressions of multiple profiled pins 66.

This embodiment again has a receiving recess 64 for a tuft of bristles 22. However, in the case of this variant, the mixing of different types of bristle (color, diameter, end region, pointed or conventional) cannot be assigned to the individual end regions, since the bristles of the individual receiving recesses 64 are assigned to the different end regions. Since, in the case of this process, again multiple receiving recesses 64 are used for each tuft of bristles 22, this tends to be used for larger tufts 22 with more than 40 bristles.

FIGS. 19*a-e* show one possible configuration of an elongate tuft of bristles 22. In FIG. 19*a*, the receiving recesses 64 of the die 62 can be seen. The profiled pins 66 assigned to the receiving recesses 64 are represented in FIG. 19*b*. The profiled pins 66 all have a straight, groove-shaped depression 68, which runs through the center point of the respective profiled pin 66. Both the receiving recesses and the corresponding profiled pins 66 are arranged along an arcuate line, to be precise in such a way that the straight, groove-shaped depressions 68 of the individual profiled pins 66 form a continuous depression 68.

FIG. 19*c* shows a plan view of the corresponding, elongate tuft of bristles 22. The raised part 75 of the tuft of bristles 22 is in turn shown in gray. The combination of the straight, groove-shaped depressions 68 of the individual profiled pins 66 achieves in the finished tuft of bristles 22 a centrally arranged continuous higher part 75 of the tuft of bristles 22 in the form of a ridge.

FIG. 19*d* shows a side view of the finished tuft of bristles 22 according to FIG. 19*c*. In FIG. 19*e*, a cross section along the line A-A in FIG. 19*d* is shown. The higher part 75 of the tuft of bristles 22 in the form of a ridge can be easily seen.

One possibility that can be used in conjunction with this embodiment is that, although the profiled pins 66 are provided with straight depressions 68, a contour in the form of a circular arc is to be created in the end product. It is possible in the process to make the transition continuous, by designing the hopper plate 63 correspondingly. With it, the transition from straight to round and continuous can be created in a simple way.

FIGS. 20*a-e* show a further possible configuration of an elongate tuft of bristles 22. In FIG. 20*a*, in turn, the receiving recesses 64 of the die 62 can be seen. The profiled pins 66 assigned to the receiving recesses 64 are presented in FIG. 20*b*. The profiled pins 66 all have a groove-shaped depression 68, this depression not necessarily running through the center point of the circular profiled pin 66. Both the receiving recesses 64 and the corresponding profiled pins 66 are arranged along a straight line. In this case, the groove-shaped depressions 68 are arranged in such a way that a slightly meandering line is obtained.

FIG. 20*c* shows a plan view of the corresponding, elongate tuft of bristles 22. The raised part 75 of the tuft of bristles 22 is in turn shown in gray. The combination of the groove-shaped depressions 68 of the individual profiled pins 66 achieves in the finished tuft of bristles 22 a continuous raised part 75 of the tuft of bristles 22 in the form of a meandering ridge. FIG. 20*d* shows a side view of the finished tuft of bristles 22 according to FIG. 20*c*. In FIG. 20*e*, a cross section along the line B-B in FIG. 20*d* is shown. The higher part 75 of the tuft of bristles 22 in the form of a ridge can be easily seen.

It should be mentioned in connection with the tufts of bristles 22 shown in FIGS. 19*a* to 20*e*, with their higher bristle tuft parts 77, that the bristle length of the higher part 75 of the tuft of bristles 22 can of course also be varied within the final tuft 22. In this way, a height profile can be realized in the ridge created. This is shown in FIGS. 24*a* to 24*e*. FIGS. 23*a* to 23*e* show the opposite situation, in which the levels of the lower bristle ends 73' form a profile.

FIGS. 22*a* to 22*g* show receiving recesses 64, profiled pins 66 and tufts of bristles 22. FIG. 22*c* shows a plan view of the finished tuft of bristles 22. FIGS. 22*d* to 22*g* show various possible embodiments of the tufts of bristles 22, the profiled pins 66 in each case being provided with correspondingly designed forms. The tufts of bristles according to FIGS. 22*d* to 22*g* show two steps 83. The corresponding areas of use 67 of these steps 83 may be oriented obliquely, wavily or else at right angles to the longitudinal direction of the bristles 39, 40. FIGS. 22*a* to 22*g* show that any desired variations and forms of the tufts of bristles 22 can be produced.

FIGS. 23*a* to 23*e* show a tuft of bristles 22 which has higher and lower bristle ends. The higher bristle ends form a level, the lower bristle ends 73' form a profile 85. As a result, the distance between the higher and lower bristle ends 73, 73' is not constant.

The receiving recesses 64 are arranged by way of example on a straight line, as shown in FIG. 23*a*. The profiled pins 66 shown in FIG. 23*b* are guided in the receiving recesses 64. The depressions 68 in this case form a contour 87, which is continuous in the final tuft of bristles 22. The configuration of the depth of the depressions 68 in this case establishes how great the difference is between the higher and lower bristle ends 73, 73'. The profiled pins 66 with the receiving recesses 64 are designed such that the lowest points of the receiving recesses 64 are at the same distance from the upper side 12 of the bristle-carrying plate 10 when the bristles 39, 40 have been led through the bristle-carrying plate 10. This achieves the effect that all the higher bristle ends 73 are at the same distance from the upper side of the bristle-carrying plate 10.

FIGS. 24*a* to 24*e* show a configurational variant in which the ridge of the tuft of bristles 22 has a variable height. The level 89 with the lower bristle ends 73' is made parallel to the upper side 12 of the bristle-carrying plate 10. The higher bristle ends 73 form the profile 85, so that the reduced part of the tuft of bristles 22, that is to say the distance between the higher and lower bristle ends 73, 73', varies. All the lower bristle ends 73' are at the same distance from the upper side 12 of the bristle-carrying plate 10. The receiving recesses 64 with the profiled pins 66 are designed accordingly, these being shown in FIGS. 24*a* and 24*b*.

The statements made about the profiling of the lower bristle ends 73' and that of the higher bristle ends 73 may also be applied analogously if more than 2 levels, i.e. more than two steps 83, are created in the tuft of bristles 22. In this case, each level may be profiled or configured in a planar manner.

It goes without saying that the tufts of bristles 22 shown in FIGS. 23*a* to 24*e* may be combined with the tufts of bristles 22 of the other embodiments described. For example, an embodiment as shown in FIGS. 23*a* to 23*e* may also be provided with a profile as shown in FIGS. 20*a* to 20*e*.

Apart from the areal tufts shown in FIGS. 19*a* to 20*e* and FIGS. 23*a* to 24*e*, it is of course also possible in said process to create isolated tufts. As shown in FIGS. 25*a* to 25*e*, these may then likewise have a profiling, which continues over the different tufts of bristles 22. The construction of the device for producing them is the same as before. The receiving recesses 64 are shown in FIG. 25*a*, the profiled pins guided therein are shown in FIG. 25*b*. In the process, it is just that these are not brought together to jointly form a tuft of bristles 22, but instead the bristles 39, 40 of each individual receiving recess 64 form a tuft of bristles 22 for themselves. The hopper plate 63 accordingly has guiding passages 91, which are arranged as a straight extension of the corresponding receiving recesses 64.

FIG. 25*c* shows the plan view of the tufts of bristles while 25*d* shows the side view of the tufts of bristles 22. Again, the region with the higher bristle ends 73 is shaded gray. FIG. 25*d* also shows the lower bristle ends 73', these forming a level. The higher bristle ends 73 form a wavy profile 85. The individual tufts of bristles 22 are spaced apart from one another in the longitudinal direction. As a result, the profile 85 or the level is not continuous. FIG. 25*e* shows a section through a tuft of bristles 22 along the line E-E from FIG. 25*d*. The higher bristle ends 73, which are arranged in the middle in the transverse direction, and the lower bristle ends 73', which are arranged on both sides of the higher bristle ends 73 in the transverse direction, can be easily seen.

The higher bristle tuft parts 77 formed in this way preferably form a continuous, stepless contour 87. However, it is also possible furthermore to make the contour 87 interrupted or indeed discontinuous.

The combining of depressions 68 in individual profiled pins 66 allows a "composite" form of the raised part to be achieved in the finished tuft of bristles, on the one hand by the arrangement of the profiled pins 66, for example along a curved line, and on the other hand by the form and arrangement of the depressions 68 in the individual profiled pins 66.

It goes without saying that all the described forms of higher parts 75 of tufts of bristles 22 can also be realized on lower parts 75' of tufts of bristles 22, and vice versa.

It has already been specified above that a variable circular arc may be used for providing the bristles 39, 40. The details of this circular arc are likewise described there. FIGS. 26*a* to 26*d* then show receiving recesses 64, profiled pins 66 and tufts of bristles 22. The tufts of bristles 22 from FIGS. 26*c* and 26*d* have been produced by means of a variable circular arc. In this case, two larger receiving recesses 64 of the die 62 and two smaller receiving recesses 64' of the die 62 form the basis for the later tuft of bristles 22. The receiving recesses 64, 64' are arranged at the corners of a rhomboid. In production, use of the variable circular arc makes it possible for the receiving recesses 64, 64' of different sizes to be filled by the same circular arc. The variability is ultimately reflected in the fact that different numbers of bristles can be transported by one displacement of the circular arc. One displacement fills a receiving recess 64.

The profiled pins 66 may be configured like the profiled pins 66 already described, profiled pins 66' of smaller diameter and profiled pins 66 of greater diameter being used to correspond to the receiving recesses 66, 66'. In this respect it is irrelevant whether the profiled pin 66 with the greater diameter is formed with a depression 68 or whether the profiled pin 66' with the smaller diameter is formed to correspond to the profiled pin 66 with the greater diameter (i.e. with depressions 68); the same configurational possibilities are always possible. In the example shown, the higher bristle ends 73 are formed by the profiled pins 66 with the greater diameter. It goes without saying that these tufts of bristles 22 with the higher bristle ends 73 could also be formed by profiled pins 66' with a smaller diameter.

FIGS. 27*a* to 27*e* show that, seen together over the entire bristle area 93, the higher bristle ends 73 do not have to form a continuous profile 85. It is possible for the higher bristle ends 73 to be aligned irregularly or relatively irregularly or freely in inclined planes with different alignment and for the lower bristle ends 73' to form a continuous level lying parallel to the upper side 12 of the bristle-carrying plate 10. This is shown. In addition, it would also be possible for the irregularity to be realized only in the case of the lower bristle ends 73' and for the higher bristle ends 73 to form a level 89. Furthermore, both the higher bristle ends 73 and the lower bristle ends 73' may be arranged irregularly or relatively irregularly or freely.

FIGS. 28*a* and 28*b* show the combined use of soft-elastic massaging and cleaning elements 95 together with the tufts of bristles 22 according to the invention. The massaging and cleaning elements 95 may be located between single or multiple tufts of bristles 22 according to the invention, as is shown in section in FIG. 28*b*. Furthermore, the soft-elastic massaging and cleaning elements 95 may entirely or partially enclose the tufts of bristles 22, as shown in FIG. 28*a*. The configurational variants with respect to height, form, etc. are discussed further above in the text.

An extremely wide variety of types of bristles may be used to realize toothbrushes according to the invention and toothbrushes produced according to the invention. Cylindrical bristles 39 or pointed bristles 40 are used with preference.

FIG. 21*a* shows the bristle end of a cylindrical bristle 39. The cylindrical bristles 39 are preferably produced from polyamide (PA). They have over the length of the bristle a substantially constant nominal diameter $\Delta_{nom}$ (diameter at the thickest point of the bristle), which is, for example, 0.15 to 0.25 mm. In the end state in the brush, the tip 22*a* of the bristle 40 is rounded off. The cross section of the cylindrical bristle 39 is preferably circular. However, other cross-sectional forms are also possible, for example square, rectangular or rhomboidal.

Pointed bristles 40 are outlined in FIG. 21*b*. Pointed bristles 40 are preferably produced from polyester (PBT) and likewise have a constant diameter over a region of their length, for example likewise a nominal diameter of 0.15-0.25 mm. The bristle 40 tapers toward the tip 40*a*, beginning at a distance a from the tip 40*a*. Measured from the tip 40*a*, the diameter of the corresponding point corresponds, for example, to the following values:

| | % of the nominal diameter | |
|---|---|---|
| Distance (mm) | Mean value | Tolerance range |
| 0.1 | 8% | 5-15% |
| 1 | 25% | 15-35% |
| 2 | 45% | 30-60% |
| 3 | 60% | 50-80% |
| 4 | 75% | 60-90% |
| 5 | 80% | 70-90% |
| 6 | 85% | >75% |
| 7 | 90% | >80% |

The pointing process is based on reduction of the diameter by means of a chemical process. Depending on the length of time during which the bristle is left in the chemical substance, the plastic disintegrates and the diameter is reduced. The form of the tip can be influenced in this way.

In principle, two types of pointed bristles 40 exist. Those which have a point only at one end and those which have a point at both ends of the bristle. As far as the dimensions are concerned, the pointing is designed in both cases in the way specified above. The bristles 40 that are pointed at one end have a point at one end, and at the other end are cylindrically designed and may be rounded off. The bristles 40 that are pointed at both ends are configured with a point at both ends.

In terms of the cross section, the pointed bristles 40 may be designed the same as the cylindrical bristles 40.

To ensure sufficient stability of the individual filaments, the nominal diameter is left over a large part of the length at over 75%. The table given above shows that the pointing of the filaments takes place predominantly over the last 4 to 5 mm. With this configuration, the tip 23*a* can optimally reach minute fissures and the interdental spaces while having sufficient stability of the filament.

Cylindrical bristles or bristles pointed at one end are preferably used for the present invention.

To achieve sufficient flexibility of the filaments, a length, from leaving the head part, of between 7 and 13 mm is chosen for all types of bristle.

In the present invention and for toothbrushes in general, the bristles 39, 40 may be completely or partially colored. Accordingly, in the case of partially colored bristles, for example, only the bristle ends or only one bristle end or else everything with the exception of the bristle ends may be colored. The coloration itself may be designed as an indicator coloration, i.e. the color is worn away during the course of use, and thus serves as an indicator of use, or else as a permanent coloration.

The cylindrical bristles 39, which are produced from polyamide, may, for example, be colored with food dyes and be provided with a coating over the dye. Possible food dyes that can be used are, for example, for blue "Aluminum Lake of 3,3'-dioxo-2,2'-diindolinyidene-5,5'-disulfonic acid", for yellow "Aluminum Lake of 5-hydroxy-1-(4-sulfophenyl)-4-(4-sulfophenylazo)-3-pyrazolecarboxylic acid" or "Aluminum Lake of 6-hydroxy-5-(4-sulfophenylazo)-2-naphthalene sulfonic acid". These dyes are designed to be suitable for food contact. Once the dyes have been applied to bristles, the surface is usually no longer of such a quality that allows automatic processing on toothbrush bristle-providing machines 97. Therefore, the entire bristles, or at least the colored portions of the bristles, are provided with a coating.

This coating makes the surface smoother, and so makes automatic processing possible.

Pointed bristles 40, which are produced from polyester, cannot be colored in this way. The coloration of these bristles 40 must take place by a chemical process, which however will not be discussed in detail at this point.

The advantage of coloration may be that the technical aspect of the bristles of different lengths can be made visible, for example if only the higher bristle ends are colored, or if only the lower bristle ends are colored. Furthermore, the design as an indicator portion can create the benefit for the customer of an indication of use.

With preference, the part of the bristles 39, 40 that comprises the higher bristle ends is colored. The coloration of both ends is nevertheless possible.

If it only concerns the tips of the bristles, the coloration has on the finished toothbrush a length of 2 mm to 10 mm, preferably between 3 mm and 8 mm. On account of the processing, the coloration is longer, or adapted, on the bristles that have not been processed, since some parts of the coloration are possibly ground away or cut away. Accordingly, the coloration in the raw material does not have to be of the same length at both ends of the bristles, just as it can also vary in the end product. Preferably, the coloration in the end product is nevertheless of the same length at both ends of the bristle if both ends of the bristle are colored.

It goes without saying that the configurational variants shown and/or described are given by way of example and the individual refinements and elements of these configurational variants may be combined with other configurational variants without departing from the scope of this invention.

The profiled pin 66 has on its end face 101 a discontinuous surface 105. This configuration of the profiled pin 66 allows two or more levels 89 of bristle ends 73 to be created. This can be easily seen, inter alia, in FIGS. 6*a*, 10*e* and 12*e*.

The continuous parts 109 of the surface 105 of the profiled pin 66 are scratch-free, that is to say polished, highly polished or lapped. This in turn can be easily seen in FIGS. 6*a*, 10*e* and 12*e*.

The mentioned, discontinuous transitions 111 in the surface 105 of the profiled pin 66 are formed as sharp edges 112.

The device, or the bristle-providing machine 97, for producing a toothbrush 8 comprises the die 62 with the profiled pins 66 guided therein, the profiled pins 66 having a highly polished or lapped surface 105.

The discontinuous transitions 111 of the surface 105 are configured with sharp edges.

The invention claimed is:

1. A toothbrush comprising:

a head region, wherein the upper side of the head region is covered with bristle tufts in an anchor-free manner, said bristle tufts forming a bristle field;

a handle region; and a neck region connecting the handle region and the head region, wherein:

at least a portion of the bristle tufts comprises a stepped profile with the free bristle ends forming end regions being offset from one another and defining the stepped profile, said stepped profile bristle tufts comprise first and second bristles with at least two different lengths with the free bristle ends standing up to different heights from the bristle-carrying upper side of the head region and forming at least two different areas of use, said stepped profile bristle tufts are arranged obliquely with respect to the bristle-carrying upper side of the head region, the first bristles are longer than the second bristles and are surrounded by the second bristles, and the free ends of the first bristles define a pointed end region including an inclined angle, and the free ends of the second bristles define an end region being substantially parallel to the bristle-carrying upper side of the head region.

2. The toothbrush as claimed in claim 1, wherein the obliquely arranged bristle tufts are inclined with respect to the vertical at an angle between 3° and 15°.

3. The toothbrush as claimed in claim 1, wherein the distance from the higher standing first bristle free ends to the lower standing second bristle free ends ranges from 0.5 mm to 5 mm.

4. The toothbrush as claimed in claim 1, wherein the bristle tufts each include a bristle tuft stock having a height from 6 mm to 11 mm, wherein the height is measured from the point where the bristles emerge from the surface of the bristle-carrying upper side of the head region.

5. The toothbrush as claimed in claim 1, wherein the stepped profile bristle tufts and tufts of conventional cylindrical bristles are arranged alternatingly in longitudinal or transverse regions in the bristle field.

6. The toothbrush as claimed in claim 1, wherein tufts of conventional cylindrical bristles forming a power tip are arranged in the front area of the bristle field, as seen in the longitudinal direction.

7. The toothbrush as claimed in claim 1, wherein tufts of conventional cylindrical bristles and tufts of pointed bristles are arranged in the bristle field.

8. The toothbrush as claimed in claim 1, wherein tufts of conventional cylindrical bristles are arranged in the inner area of the bristle field, the bristles of said tufts of conventional cylindrical bristles comprising a shorter bristle length than the bristles of the stepped profile bristle tufts.

9. The toothbrush as claimed in claim 8, wherein the tufts of conventional cylindrical bristles comprise a substantially circular cross-section.

10. The toothbrush as claimed in claim 1, wherein the obliquely arranged bristle tufts are inclined with respect to the vertical at an angle between 5° and 10°.

11. The toothbrush as claimed in claim 1, wherein the distance from the higher standing first bristle free ends to the lower standing second bristle free ends ranges from 2 mm to 3 mm.

12. The toothbrush as claimed in claim 1, wherein the bristle tufts each include a bristle tuft stock having a height from 8 mm to 10 mm, wherein the height is measured from the point where the bristles emerge from the surface of the bristle-carrying upper side of the head region.

13. A toothbrush comprising:

a head region, wherein the upper side of head region is covered with bristle tufts in an anchor-free manner, said bristle tufts forming a bristle field;

a handle region; and a neck region connecting the handle region and the head region, wherein:

at least a portion of the bristle tufts comprises a stepped profile with the free bristle ends forming end regions being offset from one another and defining the stepped profile, the stepped profile bristle tufts comprise first and second bristles with the first bristles being longer than the second bristles, and define a circular base area, as seen in the top view, with the higher standing first bristle free ends being centrally arranged within the bristle tuft, said stepped profile bristle tufts are arranged obliquely with respect to the bristle-carrying upper side of the head region, and the free ends of the first bristles define a pointed end region including an inclined angle, and the free ends of the second bristles define an end region being substantially parallel to the bristle-carrying upper side of the head region.

14. The toothbrush as claimed in claim 13, wherein the centrally arranged higher standing first bristle free ends define a circular shape, as seen in the top view.

* * * * *